US006983729B2

(12) United States Patent
Schapiro et al.

(10) Patent No.: US 6,983,729 B2
(45) Date of Patent: Jan. 10, 2006

(54) ROTARY PISTON MACHINE

(75) Inventors: Boris Schapiro, Berlin (DE); Lev Levitin, Brookline, MA (US); Naum Kruk, Berlin (DE)

(73) Assignee: RKM Rotationskolbenmaschinen, Berlin (DE)

( * ) Notice: Subject to any disclaimer, the term of this patent is extended or adjusted under 35 U.S.C. 154(b) by 0 days.

(21) Appl. No.: 10/773,093

(22) Filed: Feb. 5, 2004

(65) Prior Publication Data

US 2004/0244762 A1 Dec. 9, 2004

Related U.S. Application Data

(63) Continuation of application No. PCT/EP02/08898, filed on Aug. 8, 2002.

(30) Foreign Application Priority Data

Aug. 9, 2001 (DE) ..... 101 39 286

(51) Int. Cl.
*F02B 53/00* (2006.01)
*F01C 1/02* (2006.01)
*F01C 1/10* (2006.01)

(52) U.S. Cl. ..... 123/242; 123/220; 418/61.2; 418/61.3

(58) Field of Classification Search ..... 123/242, 123/220; 418/61.3, 61.2, 54; F01C 1/10
See application file for complete search history.

(56) References Cited

U.S. PATENT DOCUMENTS 3,285,189 A * 11/1966 Doyer ..... 418/61.3
3,301,228 A * 1/1967 Winans ..... 123/220
3,332,403 A 7/1967 Reller ..... 418/61.3
3,690,791 A * 9/1972 Dieter et al. ..... 123/242
3,799,705 A * 3/1974 Gunthard ..... 418/61.2
3,967,594 A * 7/1976 Campbell ..... 123/242
3,996,901 A * 12/1976 Gale et al. ..... 123/242
4,111,617 A * 9/1978 Gale et al. ..... 418/61.3
4,233,003 A * 11/1980 Jeng ..... 418/61.3
5,370,508 A * 12/1994 Barthod et al. ..... 418/61.3
5,380,177 A * 1/1995 Leroy et al. ..... 418/61.3
5,810,574 A * 9/1998 Marx et al. ..... 418/61.3

FOREIGN PATENT DOCUMENTS

DE 3633536 A1 * 7/1987
DE 19920289 C1 * 7/2000
JP 58138201 A * 8/1983
JP 10220238 A * 8/1998
JP 2002309951 A * 10/2002
WO WO 98 49435 A 11/1998

* cited by examiner

*Primary Examiner*—Thai-Ba Trieu
(74) *Attorney, Agent, or Firm*—Lawrence G. Fridman

(57) ABSTRACT

A rotary piston machine having a housing defining a prismatic chamber the cross section of which forms an oval of odd order. A rotary piston is guided in the chamber and, in each position, subdivides the chamber into two working chambers. Piston-fixed instantaneous axes of rotation of the rotary piston are defined in a center plane. The rotary piston, in each interval of movement, is rotating with one of opposite nappe sections in an inner wall section about an associated instantaneous axis of rotation and is sliding with the opposite nappe section along the opposite second inner wall section of the chamber and is reaching a stop position there.

20 Claims, 32 Drawing Sheets

Fig. 16

Fig. 7.1
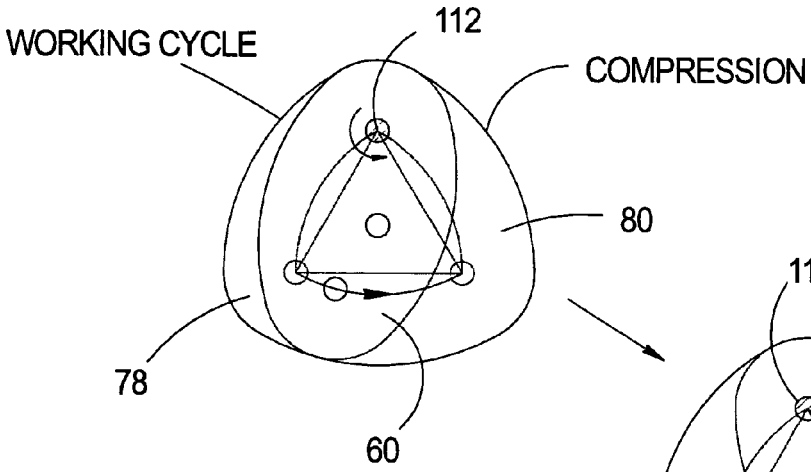
Fig. 7.2
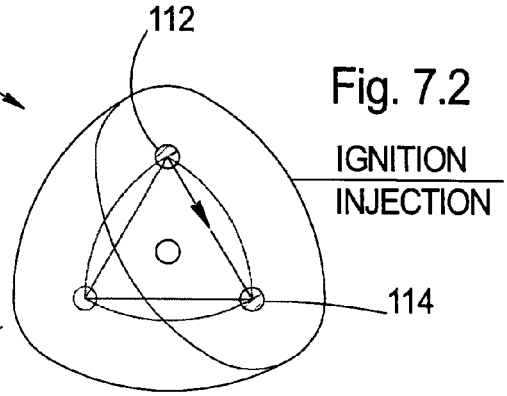
Fig. 7.3
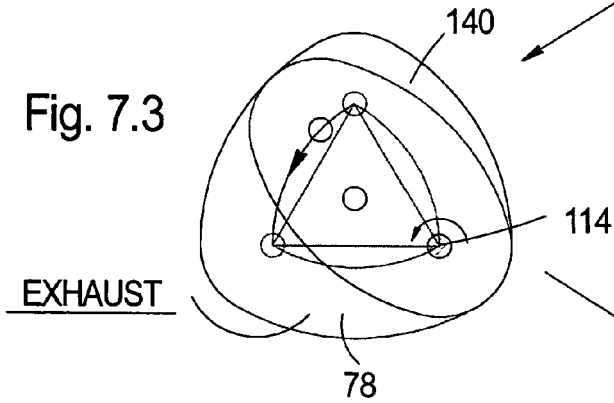
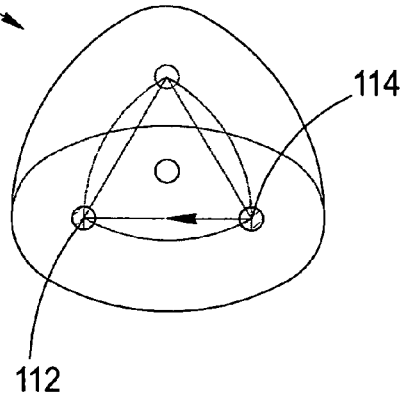
Fig 7.4

Fig. 7.5
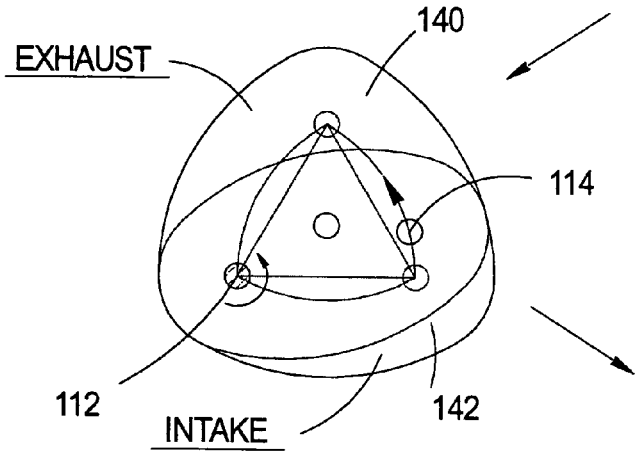
Fig. 7.6
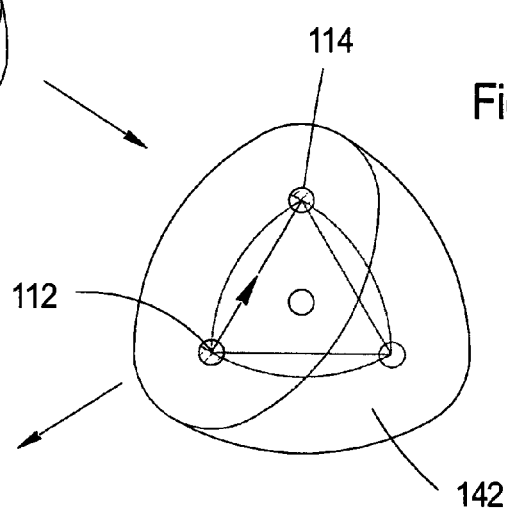
Fig. 7.7
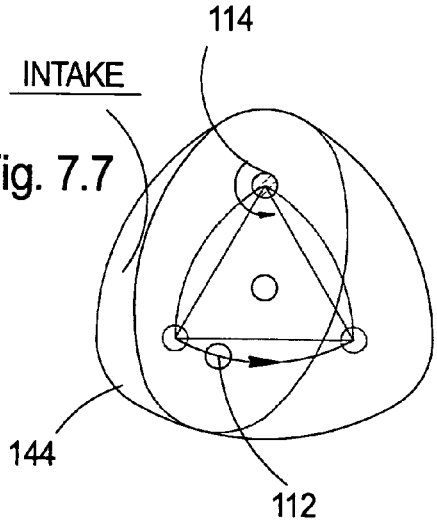
Fig. 7.8
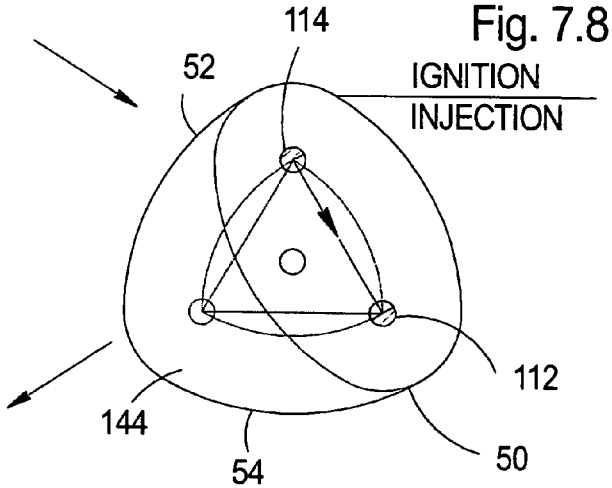

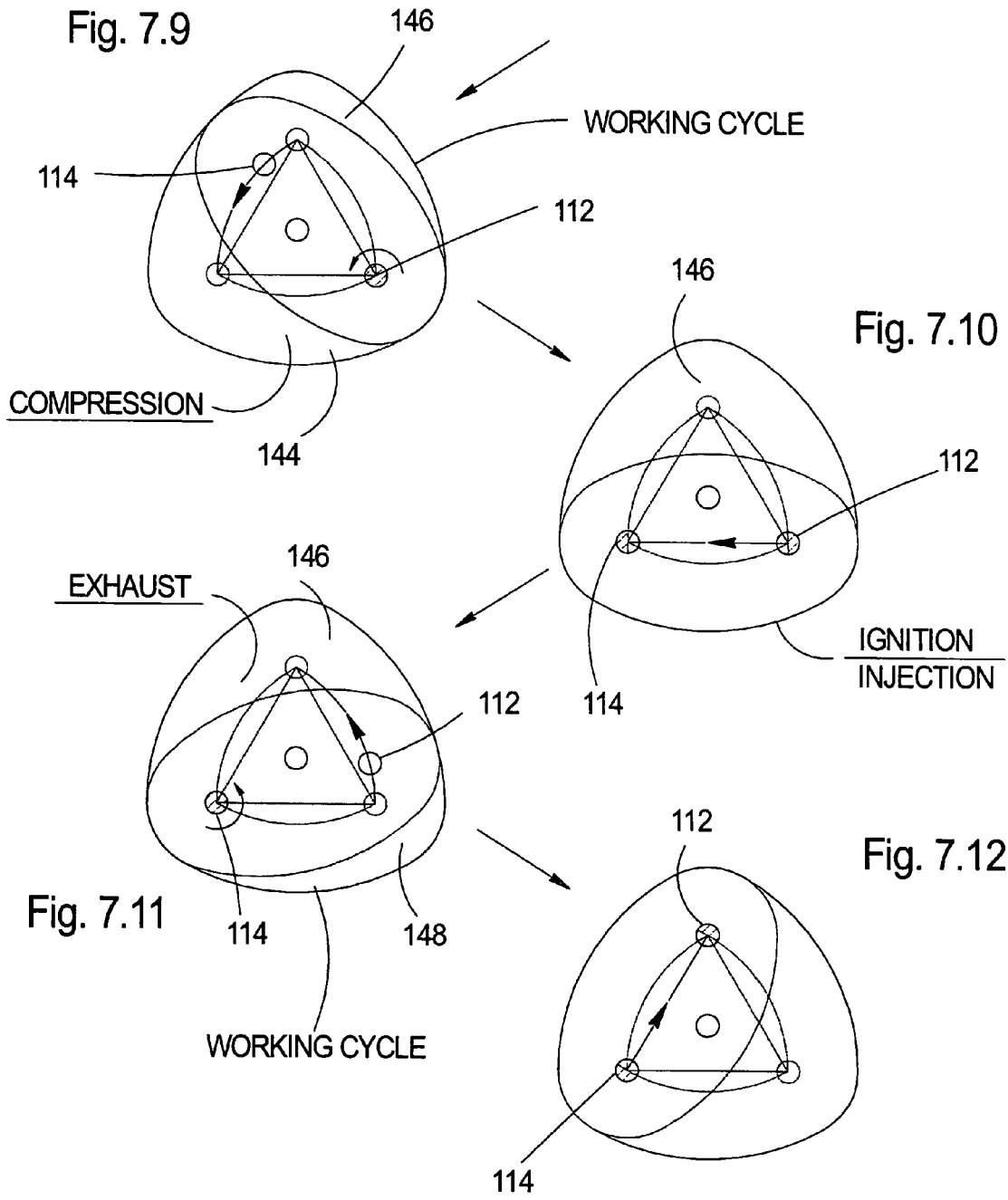
Fig. 7.9
146
WORKING CYCLE
114
112
COMPRESSION
144
146
Fig. 7.10
112
IGNITION
INJECTION
114
EXHAUST
146
112
114
148
Fig. 7.11
WORKING CYCLE
112
Fig. 7.12
114

Fig. 11.1
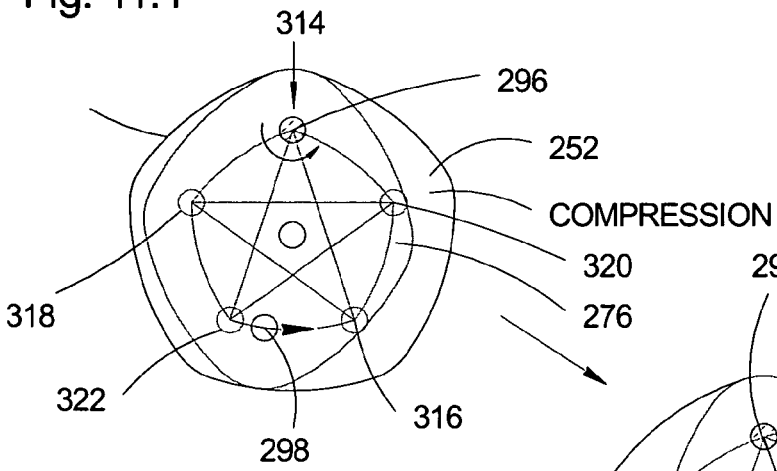
Fig. 11.2
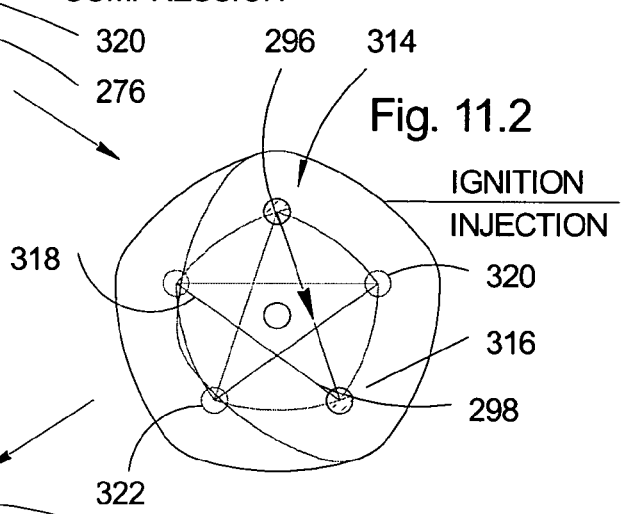
Fig. 11.3
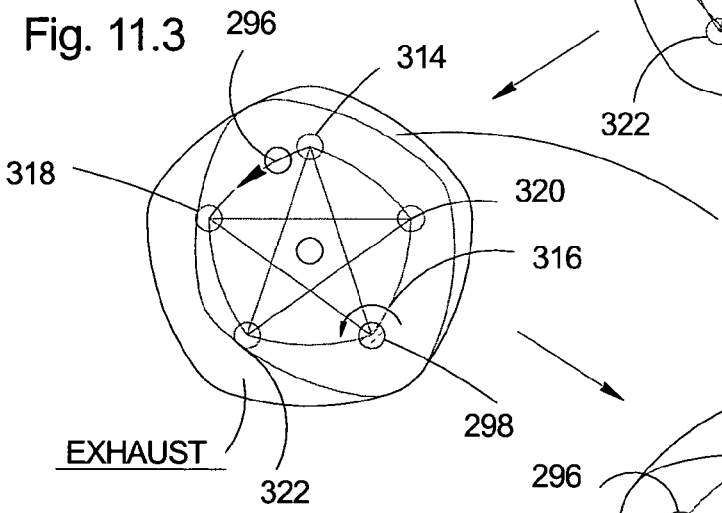
Fig.11.4
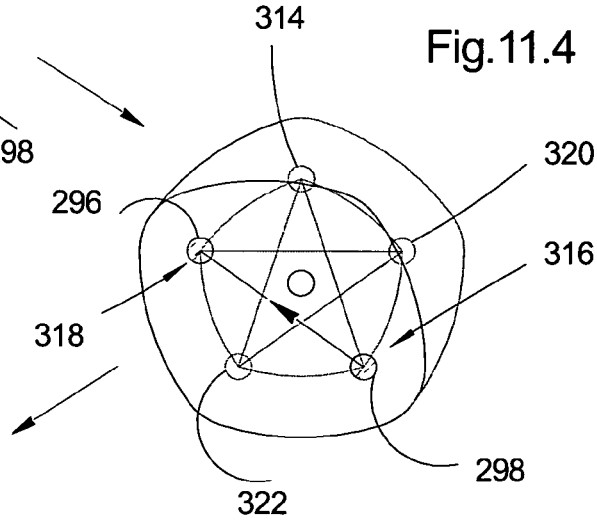

Fig. 11.5
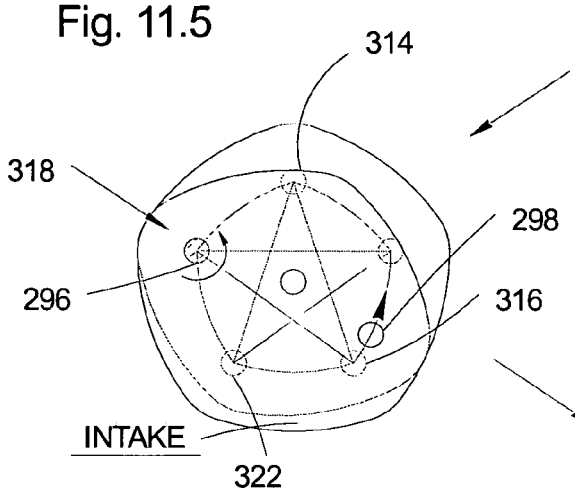
Fig. 11.6
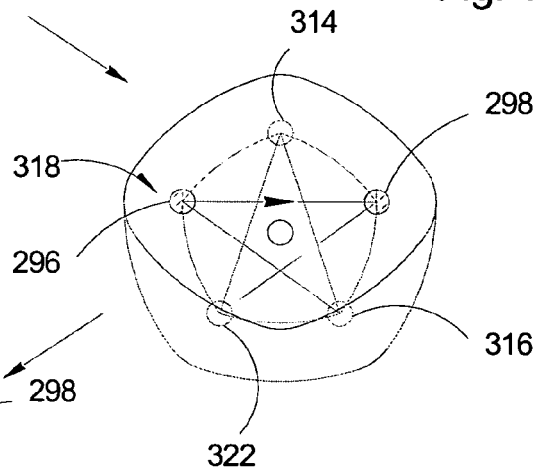
Fig. 11.7
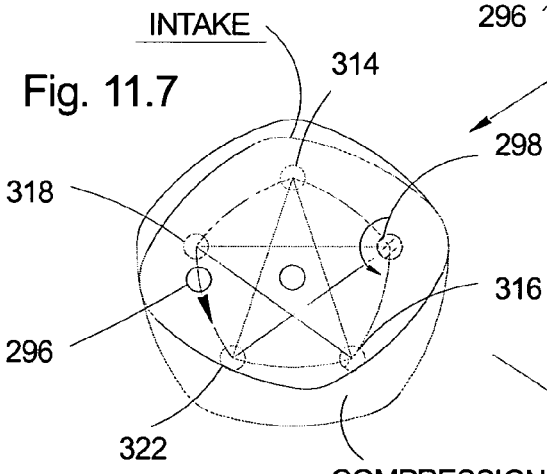
Fig. 11.8
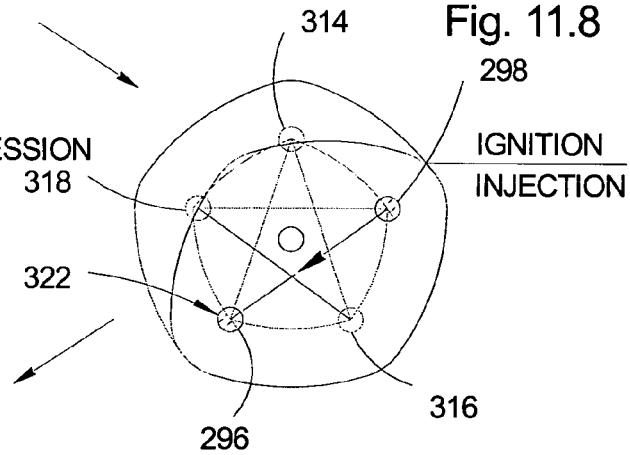

Fig. 11.9
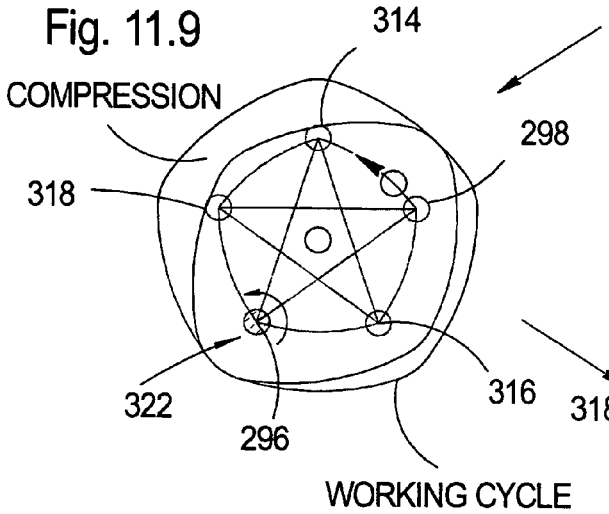
Fig. 11.10
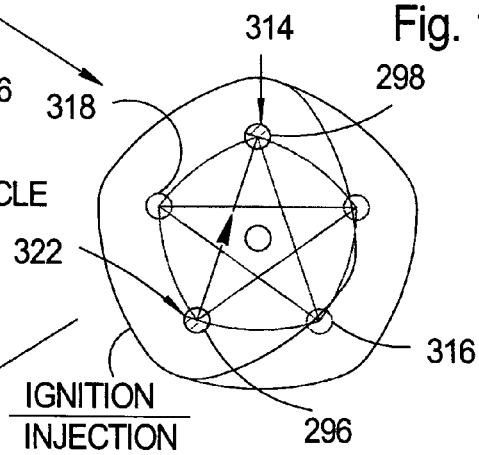
Fig 11.11
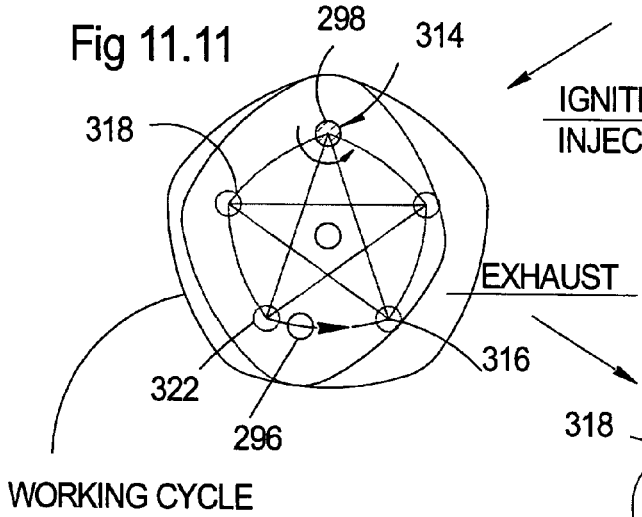
Fig. 11.12
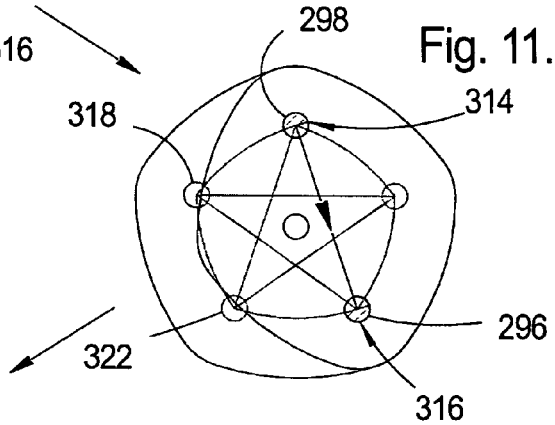

Fig. 11.13
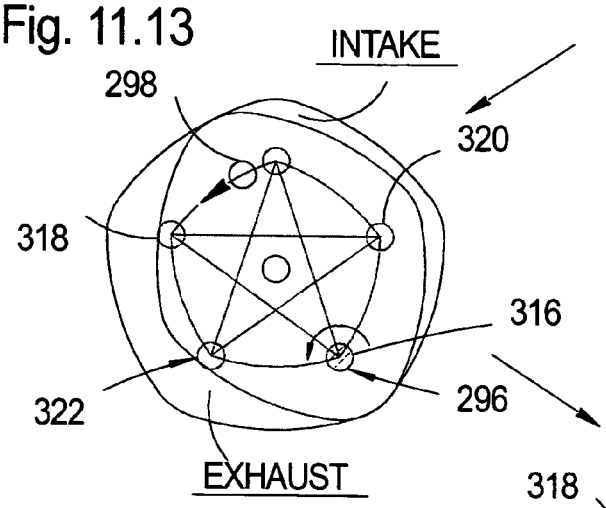
Fig. 11.14
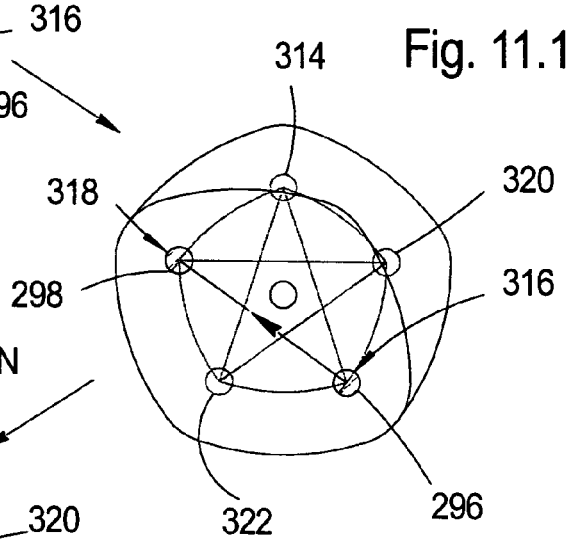
Fig. 11.15
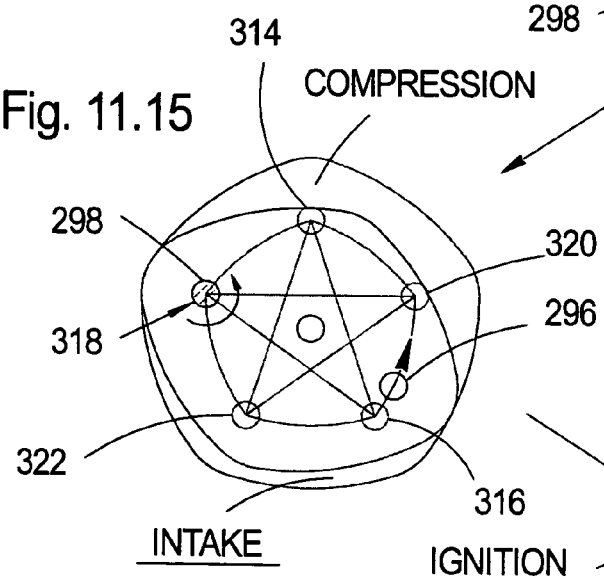
Fig. 11.16
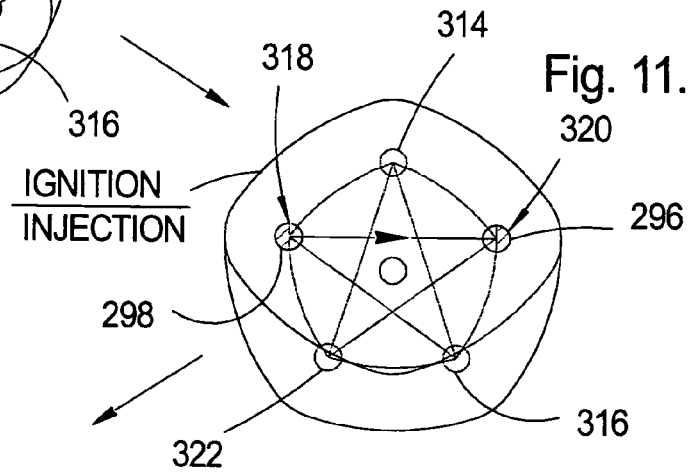

Fig. 11.17
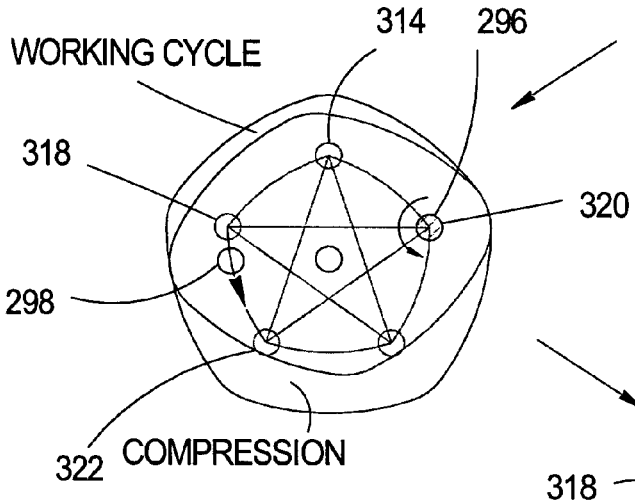
Fig. 11.18
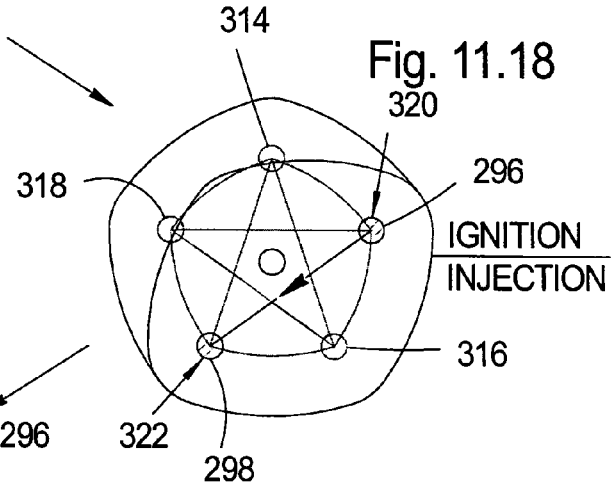
Fig. 11.19
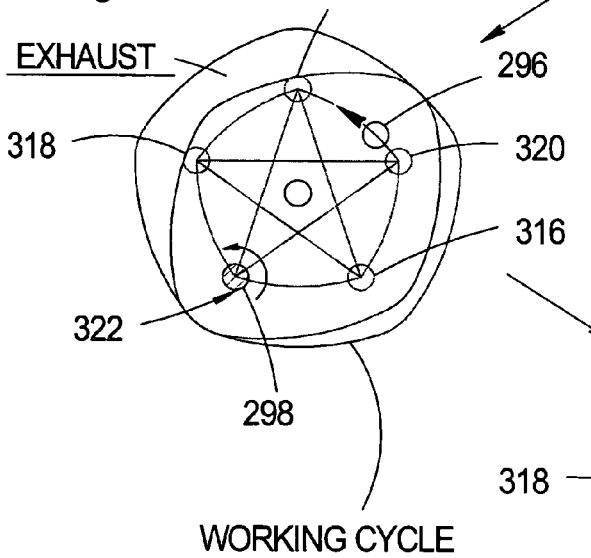
Fig. 11.20
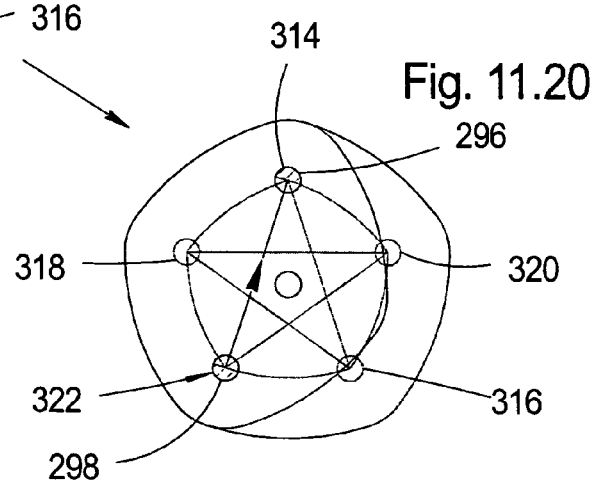

Fig. 15.1
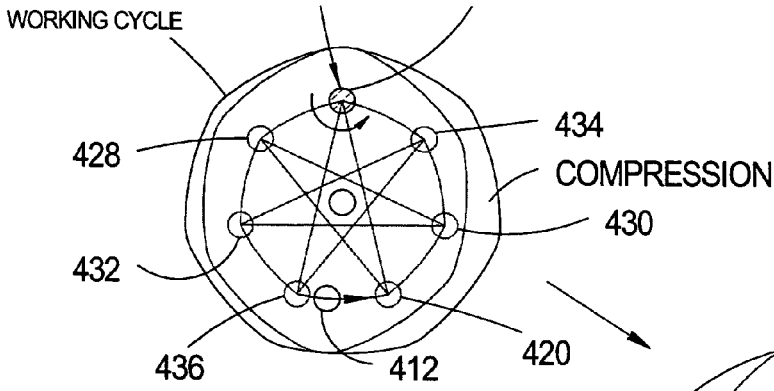
Fig. 15.2
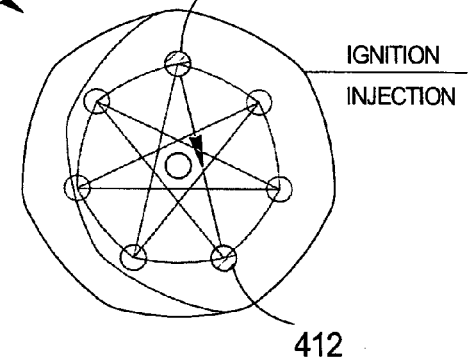
Fig. 15.3
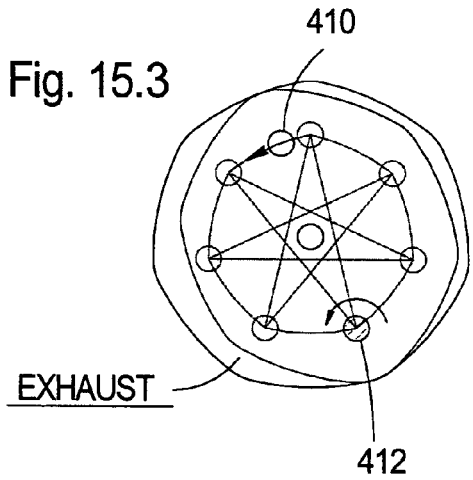
Fig. 15.4
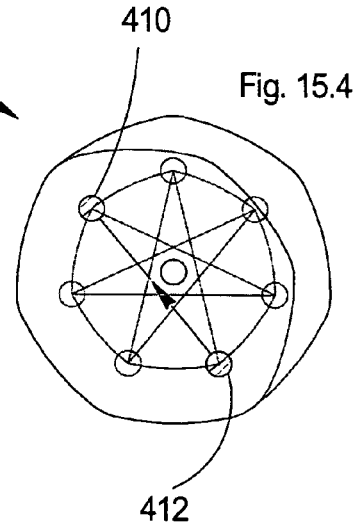

Fig. 15.5
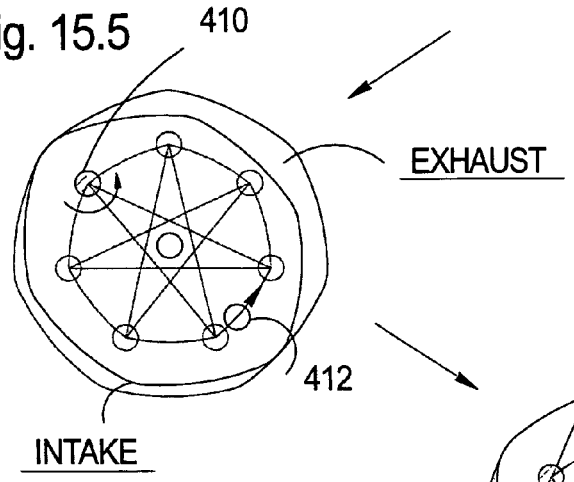
Fig.15.6
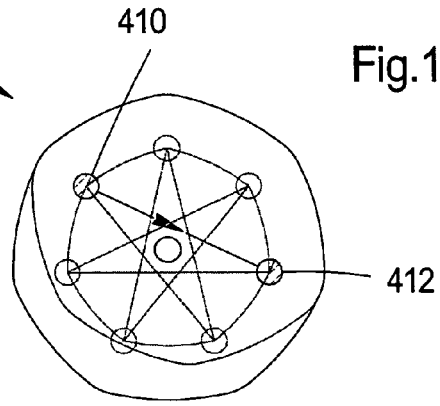
Fig. 15. 7
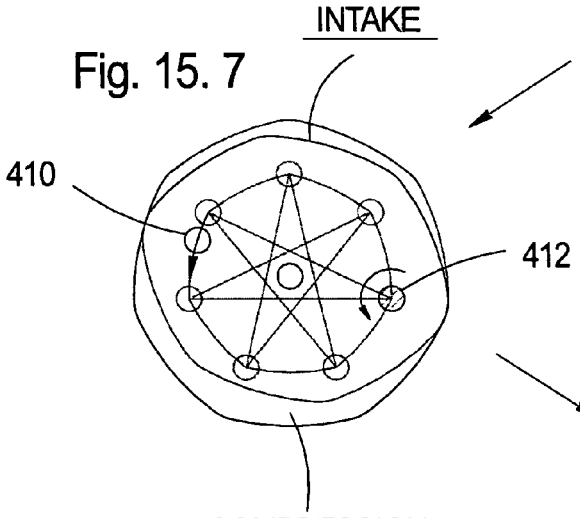
Fig. 15.8
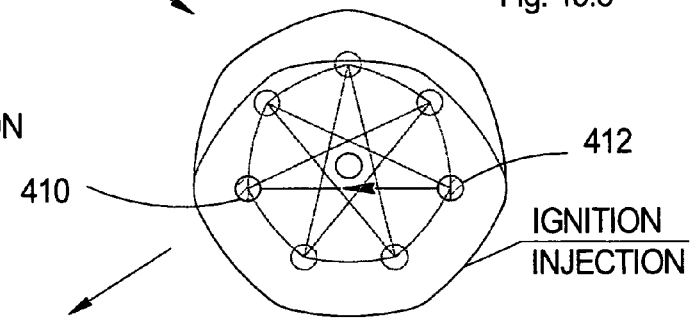

Fig. 15.9
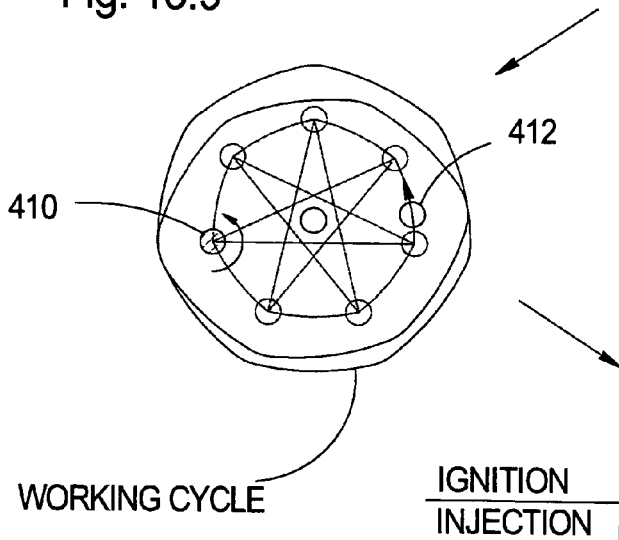
Fig. 15.10
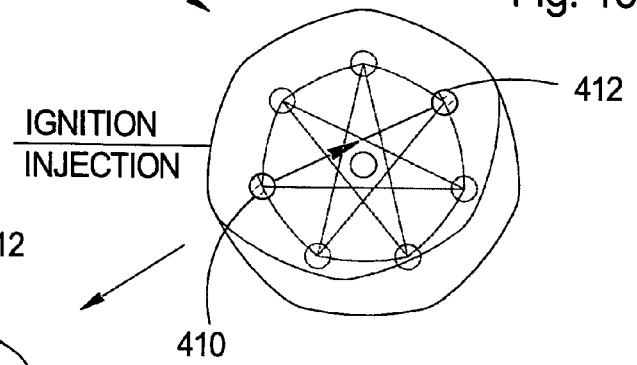
Fig. 15.11
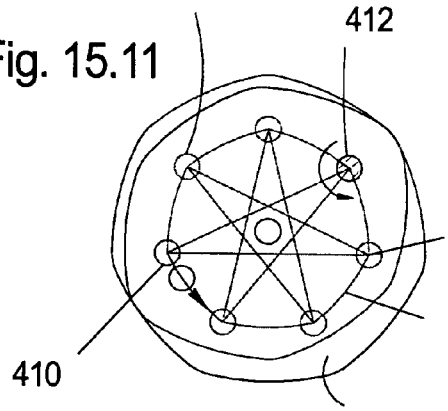
Fig. 15.12
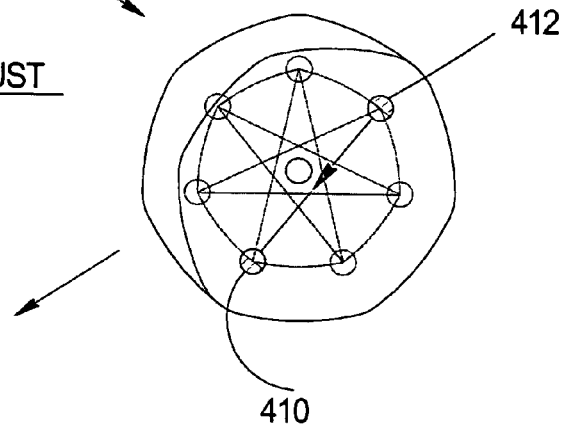

Fig. 15.13
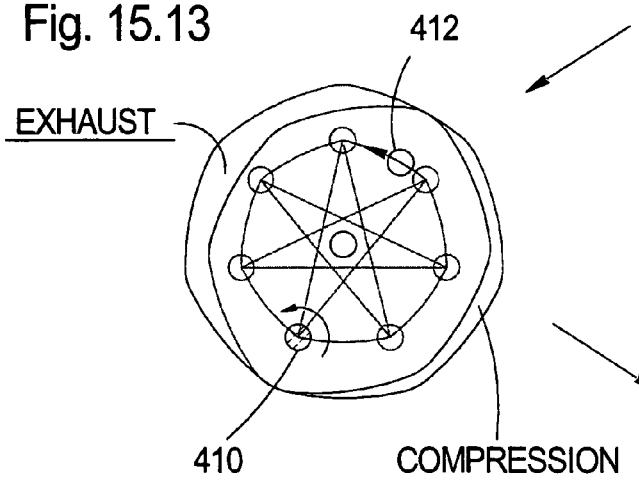
Fig. 15.14
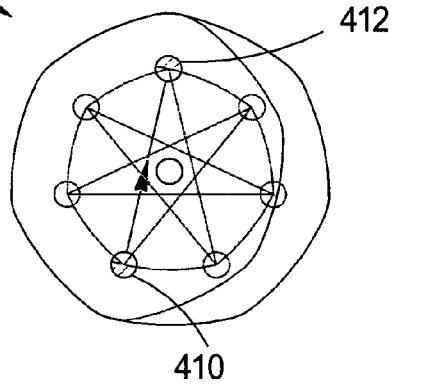
Fig. 15.15
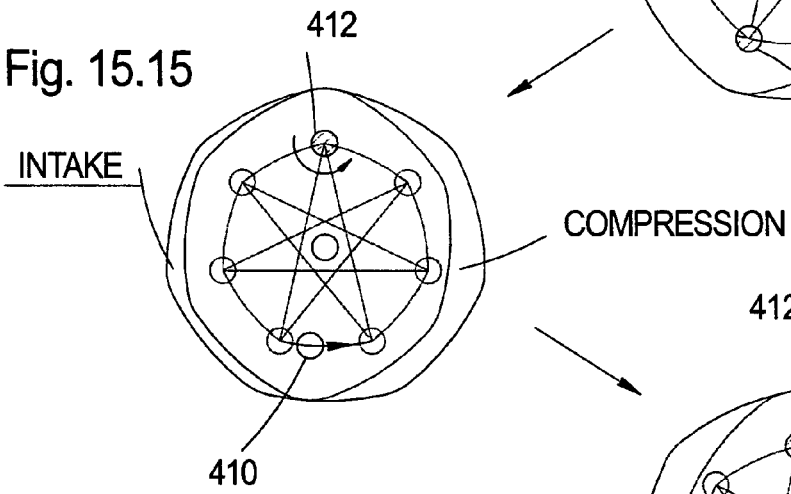
Fig. 15.16
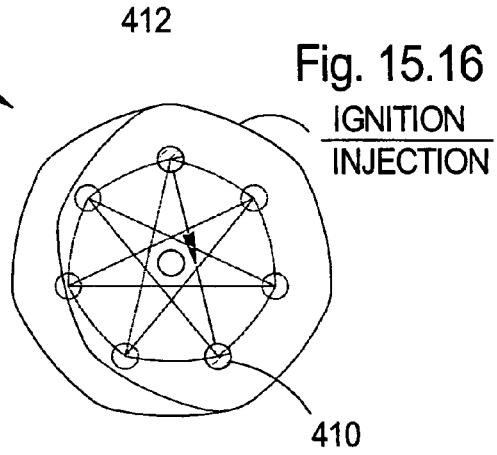

Fig. 15.17
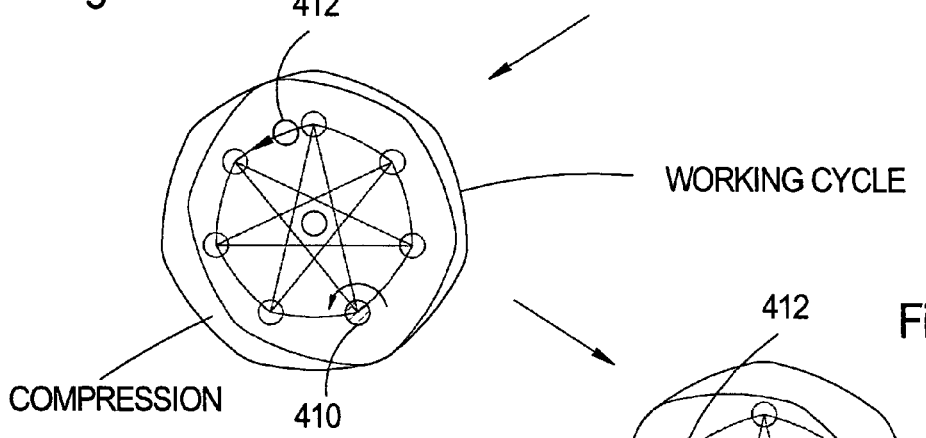
Fig. 15.18
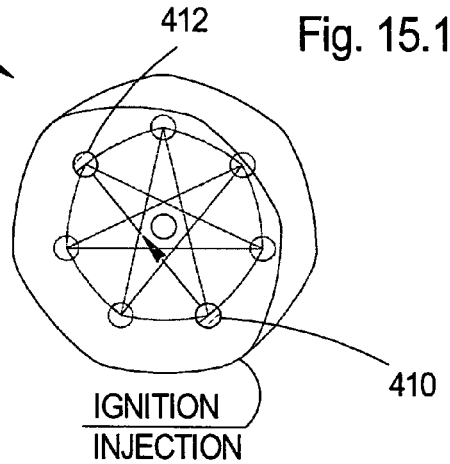
Fig. 15.19
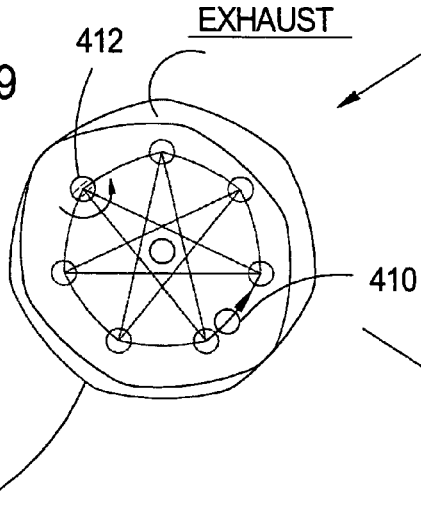
Fig. 15.20
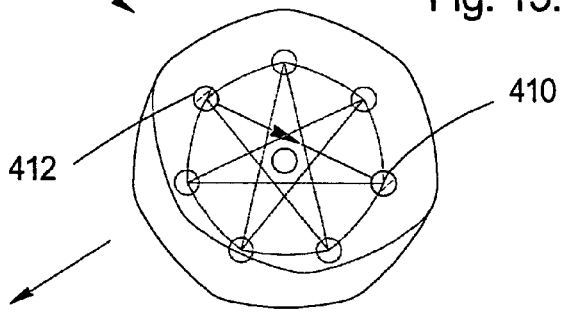

Fig. 15.21
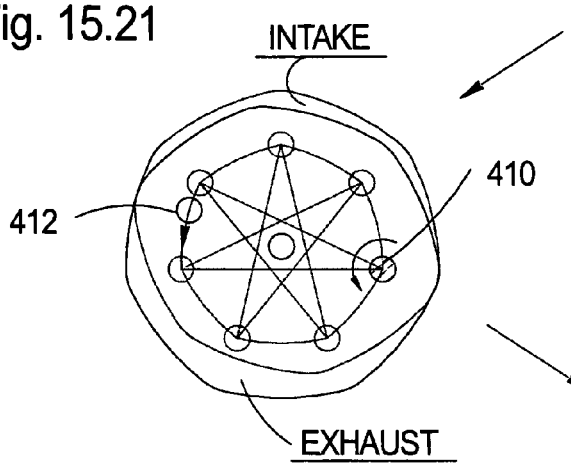
Fig. 15.22
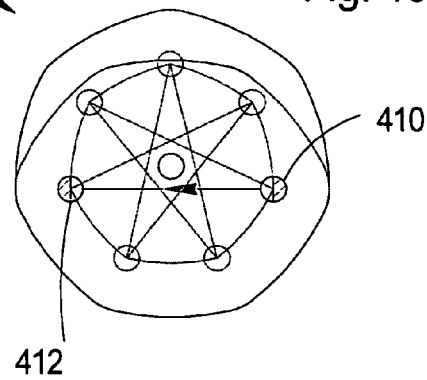
Fig. 15.23
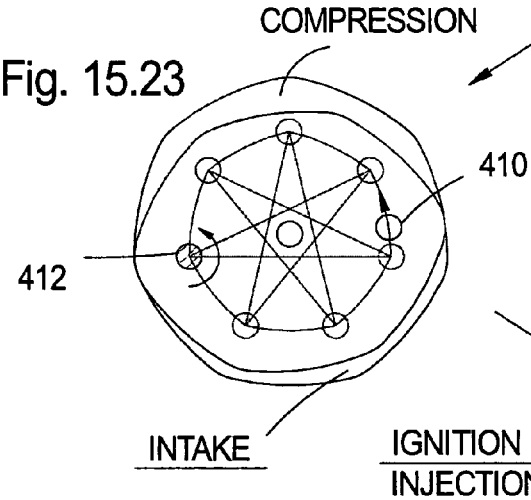
Fig. 15.24
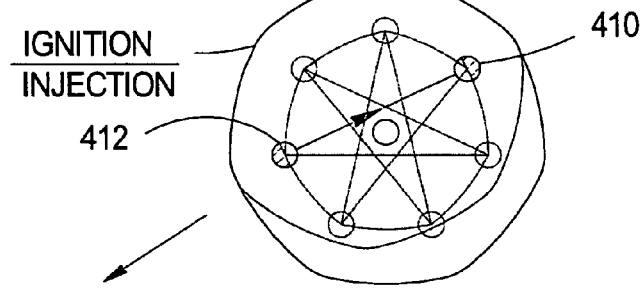

Fig. 15.25
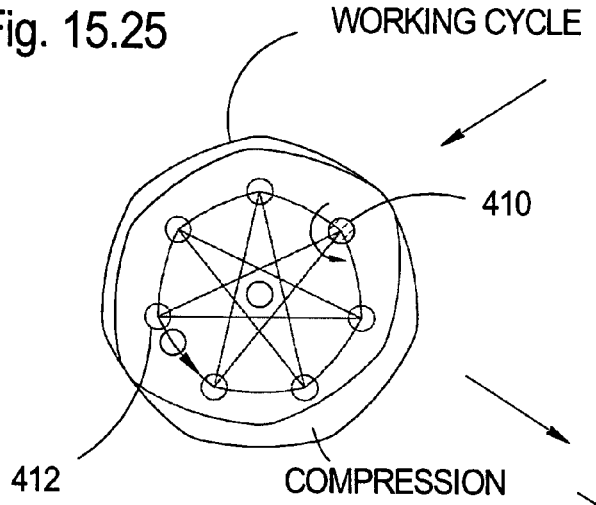
Fig. 15.26
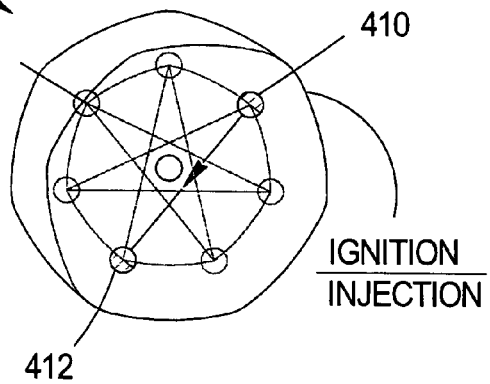
Fig. 15.27
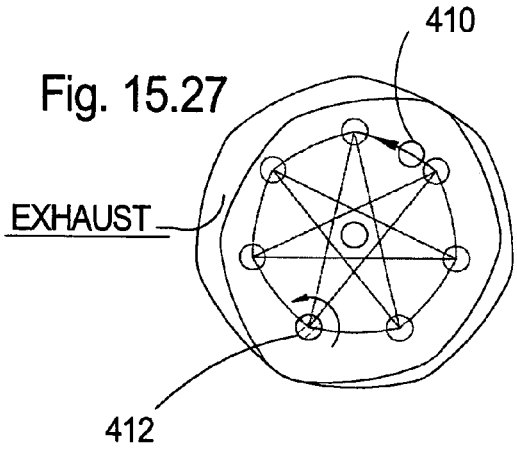
Fig. 15.28
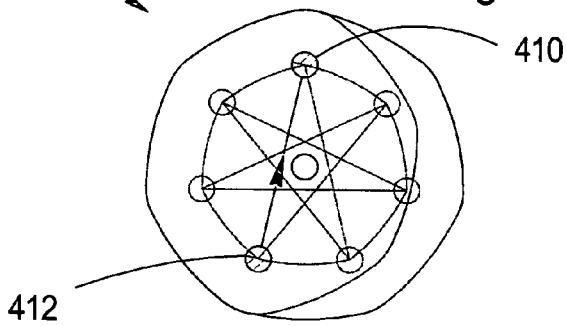

ROTARY PISTON MACHINE

THIS APPLICATION IS A CONTINUATION OF INTERNATIONAL APPLICATION PCT/EP02/08898 FILED AUG. 8, 2002, WHICH CLAIMS PRIORITY OF GERMAN PATENT APPLICATION S.N. 101 39 286.9 FILED AUG. 9, 2001.

The invention relates to a rotary piston machine with an oval chamber and a preferably oval rotary piston guided therein.

In mathematics, an "oval" is a non-analytic, closed, plane convex figure, which is composed of circular arcs. The circular arcs are composed continuously and differentiably. In the points, in which the circular arcs join each other, the curve is continuous. Also the tangents in which the two circular arcs change into each other coincide. The curve is differentiable. In the points where the circular arcs join the second derivative—which determines the curvature—has a discontinuity. The oval consists, alternatingly, of circular arcs having a first, relatively small radius of curvature and a second, relatively large radius of curvature. The order of the oval is determined by the number of pairs of circular arcs with the first and the second radius of curvature. An oval of second order or bi-oval is "ellipse-like" with two diametrically opposite circular arcs of smaller diameter, which are interconnected by two circular arcs of larger diameter.

The invention relates to a rotary piston machine, wherein a housing forms a prismatic chamber, the cross section of which represents an oval of odd order, thus, for example, an oval of third order. The chamber forms cylindrical inner wall sections alternatingly with the first smaller and the second larger radius of curvature. A rotary piston is movable in such an oval of third (fifth or seventh and higher) order, the cross section of the rotary piston, preferably but not necessarily, being an oval, the order of which is by one lower than the order of the oval of the chamber. The oval used for the rotary piston—even if it has a higher order—has a twofold symmetry, i.e. it is mirror symmetric with respect to two mutually orthogonal axes. This rotary piston has two diametrically opposite nappe sections, the radii of curvature of which are equal to the smaller (first) radius of curvature of the oval of the chamber. If the cross section of the rotary piston forms an oval, then the second, larger radius of curvature of this oval is equal to the second radius of curvature of the oval defining the chamber. In a certain interval of movement, this cylindrical nappe section of the rotary piston is located in a cylindrical inner wall section complementary thereto of the chamber, which section has the same smaller radius of curvature. The second diametrically opposite cylindrical nappe section of the rotary piston slides along the opposite cylindrical inner wall section of the chamber, which section has the larger radius of curvature. In this way, two working chambers are defined in the chamber by the rotary piston, of which, during rotation of the rotary piston, one becomes larger and the other one becomes smaller. The rotary piston, during this motion, rotates about an instantaneous axis of rotation. This instantaneous axis of rotation coincides with the cylinder axis of the first cylindrical nappe section. Therefore, this instantaneous has a well-defined position relative to the rotary piston. In this interval of movement, this instantaneous axis of rotation, of course, also coincides with the housing-fixed cylinder axis of the cylindrical inner wall section of smaller radius of curvature, in which the rotary piston rotates. This rotation continues, until the second cylindrical nappe section of the rotary piston reaches a stop position. In this stop position, the second cylindrical nappe section is located within the smaller diameter inner wall section following the opposite inner wall section of larger radius of curvature.

Further rotation of the rotary piston about the axis of rotation valid up to now is no longer possible. Therefore, the instantaneous axis of rotation, for the next interval of movement, jumps into another position, namely the cylinder axis of the second cylindrical nappe section. Also this new instantaneous axis of rotation is in a well-defined position relative to the rotary piston. It coincides, during the next interval of movement, with the cylinder axis of the cylindrical inner wll section, in which now the second cylindrical nappe section of the rotary piston rotates. During this interval of movement, the "first" cylindrical nappe section again slides along the oppisit inner wall section having the larger radius of curvature.

With such a rotary piston machine, the rotary piston always rotates in the same direction of rotation but alternatingly about different instantaneous axes of rotation, the axes of rotation "jumping" after each interval of movement. Two such instantaneous axes of rotation are defined with reference to the piston, namely by the cylinder axes of the diametrically opposite cylindrical nappe sections. With reference to the housing and to the chamber defined therein, the instantaneous axis of rotation jumps between the "corners" of the oval, thus the cylinder axes of the inner wall sections having the smaller radius of curvature.

During each interval of movement, the volume of one working chamber is increased up to a maximum value, while the volume of the respective other working chamber is decreased to a minimum value. In the ideal case, when the cross section of the rotary piston is also an oval, the volume of the working chamber is increased from virtually zero to the maximum value, or is decreased to virtually zero, respectively. Such a rotary piston machine can be used as a two or four cycle combustion engine (with internal combustion). It may, however, also operate as a compressed air motor, as a hydraulic motor or as a pump.

PRIOR ART

U.S. Pat. No. 3,967,594 and U.S. Pat. No. 3,996,901 disclose rotary piston machines having an oval piston in an oval chamber. In this design, the cross section of the piston is bi-oval. This bi-oval piston is movable in a tri-oval chamber. In this prior art rotary piston machine, expensive transmissions are provided, in order to transmit the rotary movement of the rotary piston to the driving or driven shaft.

DE 199 20 289 C1 also describes a rotary piston machine, wherein the cross section of a prismatic chamber defined in a housing is tri-oval with first and second circular arcs of alternatingly a smaller radius of curvature and a larger radius of curvature changing into each other continuously and differentiably. A rotary piston with bi-oval cross section is guided in the chamber. The bi-oval cross section is defined, alternatingly, by first and second circular arcs having the smaller and larger, respectively, radii of curvature of the tri-oval cross section of the chamber, which again change into each other continuously and differentiably. The bi-oval rrotary piston carries out the cycles of movement described above with the jumping instantaneous axes of rotation. There, the movement of the rotary piston is picked-off in a very simple way: A driving or driven shaft carries a pinion. The rotary piston has an oval aperture with an internal toothing. The longer axis of the cross section of the aperture extends along the short axis of the bi-oval cross section of the rotary piston. The pinion continuously meshes with the internal toothing.

DISCLOSURE OF THE INVENTION

The invention is based on the following discovery:

With the prior art rotary piston machines of the type mentioned in the beginning, problems may arise in those moments, when the instantaneous axis of rotation, after completion of one interval of movement, and prior to the beginning of the next interval of movement jumps from one position to the other one. In this position, namely, the kinematics is not "closed". If, at this moment, a force transverse to the connection plane of the two possible instantaneous axes of rotation is exerted on the rotary piston out of the working chamber, for example because a fuel mixture is ignited in the working chamber having minimum volume, then the rotary piston may be urged transversely into the other working chamber, which tapers like an "arcuate triangle", and may jam therein. Then the piston does not carry out a rotary movement about the new instantaneous axis, but both axes are moved translatorily into a jamming position. This risk exists, in particular, with slow movements of the rotary piston, where the rotary piston is not yet maintained in further rotation over the jump of the axis of rotation, by the kinetic energy of its rotation.

It is an object of the invention to ensure, in a rotary piston machine of the type mentioned in the beginning, safe and reliable transition from one instantaneous axis of rotation to the other one, when changing from one interval of movement to the next one.

This object is achieved by fixing means for temporarily fixing the instantaneous axis of rotation for the subsequent interval of movement, when said changed position has been reached.

In this way, the kinematics is closed. It is ensured that the rotary piston during transition from one interval of movement to the other one positively carries out a rotary movement about the new instantaneous axis of rotation an cannot make translatory movement in transverse direction. Once the continuing rotation of the rotary piston has been ensured in this way, the fixing may be released again. The fixing should be released as soon as possible in order not to cause unnecessary friction.

The fixing means have to release the rotary piston prior to reaching the next stop position.

Fixing can be achieved in that coupling structures are provided on one end face of the rotary piston in the area of the possible piston-fixed instantaneous axes of rotation, and axially movable shafts having complementary coupling structures are mounted on the side of the housing and on the axes of the first cylindrical inner wall sections, which structures are moved into engagement with the coupling structures of the rotary piston to fix the respective instantaneous axis of rotation. To this end, the piston-side coupling structures may be conical recesses in the end faces of the rotary piston and the shaft-side coupling structures may be conical heads, which can be inserted into the conical recesses to establish the coupling. Because of the conical structures, the shaft and the rotary piston will be centerd to each other.

The shafts may be actuated by electrical actuators, for example by solenoids, which are energised .at certain moments of the interval of movement. This provides a simple design, as commercially available components can be used. Because of the electrical actuation, the actuating moments can be adjusted conveniently, and the time response of the system can be taken into account by conventional electrical or electronic means. The electrical actuators may be controlled by sensor means, which respond to the rotary motion of the driving or driven shaft.

Similar to the DE 199 20 289 C1, the torque can be picked off or exerted in simple way in that a driving or driven shaft with a pinion extends centrally through the chamber, and the rotary piston has an aperture which is elongated in cross section, the longer axis of the aperture being normal to the center plane of the rotary piston, and the aperture has an internal toothing which meshes with the pinion.

The shape of the aperture is determined by the shape of the rotary piston and the diameter of the pinion. The lateral edges of the aperture are circular arcs, which are curved about the two instantaneous axes of rotation. At both ends, the circular arcs are interconnected by circular arcs the radii of which are substantially equal to the radius of the pinion. The axis of the driving or driven shaft moves, during the revolution of the rotary piston, along a trajectory in the shape of a "two-angle", i.e. a curve having two oppositely curved circular arcs forming two corners.

If the radii of the interconnecting circular arcs at the end of the aperture were smaller than the radius of the pinion, then the pinion would not have space and would jam between the circular arcs curved about the instantaneous axes of rotation. If the radii of the interconnecting circular arcs were substantially larger than the radius of the pinion, then the continuous drive would not operate. In the transition moment between the cycles of movement, the pinion would have to change over from one of the circular arcs curved about the instantaneous axes of rotation to the other one. During this change-over, cinematic problems can arise with a continuous, concave internal toothing along the edges of the aperture.

According to a further modification, provision is made that the internal toothing has opposite concave gear racks on both sides of the longer axis of the aperture, and the internal toothing, furthermore, comprises non-concave end toothings at the ends of the aperture. The end toothings may be linear gear racks. The end toothings may, however, also be concave gear racks.

Surprisingly, it can be shown that with such structure of the end toothings of the aperture the cinematic problems arising with the prior art can be solved.

In order to achieve high efficiency, the rotary piston ought to be guided in the oval chamber as easy-running as possible to keep friction and wear low. On the other hand, a safe seal between the working chambers has to be ensured. Leaks also reduce the efficiency.

To this end, advantageously, longitudinal grooves are formed in said diametrically opposite cylindrical nappe sections of the rotary piston, the grooves accommodating seals for sealing between the working chambers, the seals engaging the inner surface of the chamber, the longitudinal grooves being arranged to be connected, through a valve assembly controlled by the pressure difference between the working chambers, with the working chamber of higher pressure, if a large pressure difference occurs. The valve assembly may comprise a bore provided in the rotary piston between the working chambers adjacent the rotary piston, the bore being separated, at both ends, from the working chambers by sleeve-shaped closure pieces, and a slide valve being guided in the bore and being provided with reduced diameter sections on both sides, whereby, in end positions of the slide valve a respective reduced diameter section engages the connection bore of the adjacent closure piece.

If the pressure difference between the working chambers is small, then the seals can engage the inner wall of the oval chamber with small force. This reduces friction and increases the efficiency. If a large pressure difference occurs, then the pressure prevailing in the working chamber of higher pressure is directed under the seals. The seals are urged more strongly into engagement with the inner wall of the chamber. The higher pressure acting on the slide valve shifts the slide valve in the bore towards the side of lower pressure. Thereby, the connecting bore is closed by the reduced diameter section. Then the higher pressure prevails within the bore and becomes effective in the grooves under the seals.

In order to improve the sealing effect with low contact pressure, the seals may have a convex profile matching with the radius of curvature of one of the cylindrical inner wall sections. Preferably, this is achieved in that pairs of parallel grooves and seals are provided in the two diametrically opposite cylindrical nappe sections, and one seal of each pair has a convex profile with the first radius of curvature, and the other seal of each pair has a convex profile with the second radius of curvature.

Another, particularly advantageous solution is that the seals are longitudinally subdivided into (notional) strips, the radius of curvature in at least one strip is equal to the smaller radius of curvature of the first inner wall sections and in at least one strip is equal to the larger radius of curvature of the second inner wall sections. Each of the seals, in two outer strips has the smaller radius of curvature and, in the intermediate inner strip, has the larger radius of curvature.

Another aspect of the invention provides that the cross section of the chamber of the rotary piston machine is an oval of odd order $(2n+1)>3$, and the cross section of the rotary piston is an oval of even order 2n, in particular a quatro-oval or a sext-oval, the rotary piston having two diametrically opposite main apexes with the two diametrically opposite cylindrical nappe surfaces, and the piston-side possible instantaneous axes of rotation are located on the center plane interconnecting the main apexes.

This aspect of the invention is based on the discovery that an oval of higher order than two can be used as piston without increasing the number of (piston-fixed) possible axes of rotation.

Rotary piston machines with chambers and rotary pistons of higher order permit realisation of drives having extremely low rotary speeds with correspondingly extremely high torques and particularly high positioning accuracy of the driven shaft.

In a further modification of the invention, the combustion chamber has a cross section which has the shape of a figure of equal height, and the piston has a shape adapted to the shape of the combustion chamber, wherein the piston is mirror-symmetric to the center plane, the center plane intersecting two centers of curvature of the combustion chamber which have maximum distance from each other, and the nappe of the piston, in one stop position on one side of the center plane, completely abuts the inner wall of the smaller portion of the combustion chamber resulting therefrom.

Embodiments of the invention are described in greater detail with reference to the accompanying drawings.

BRIEF DESCRIPTION OF THE DRAWINGS

FIGS. 7.1 to 7.12 show the motion phases of the rotary piston in the arrangement of FIG. 1.

FIGS. 11.1 to 11.20 show, similarly to FIGS. 7.1 to 7.12, the motion phases of the rotary piston in the arrangement of FIG. 2.

FIGS. 15.1 to 15.28 show, similarly to FIGS. 7.1 to 7.12, the motion phases of the rotary piston in the arrangement of FIG. 3.

DESCRIPTION OF THE PREFERRED EMBODIMENT

Figure 1:
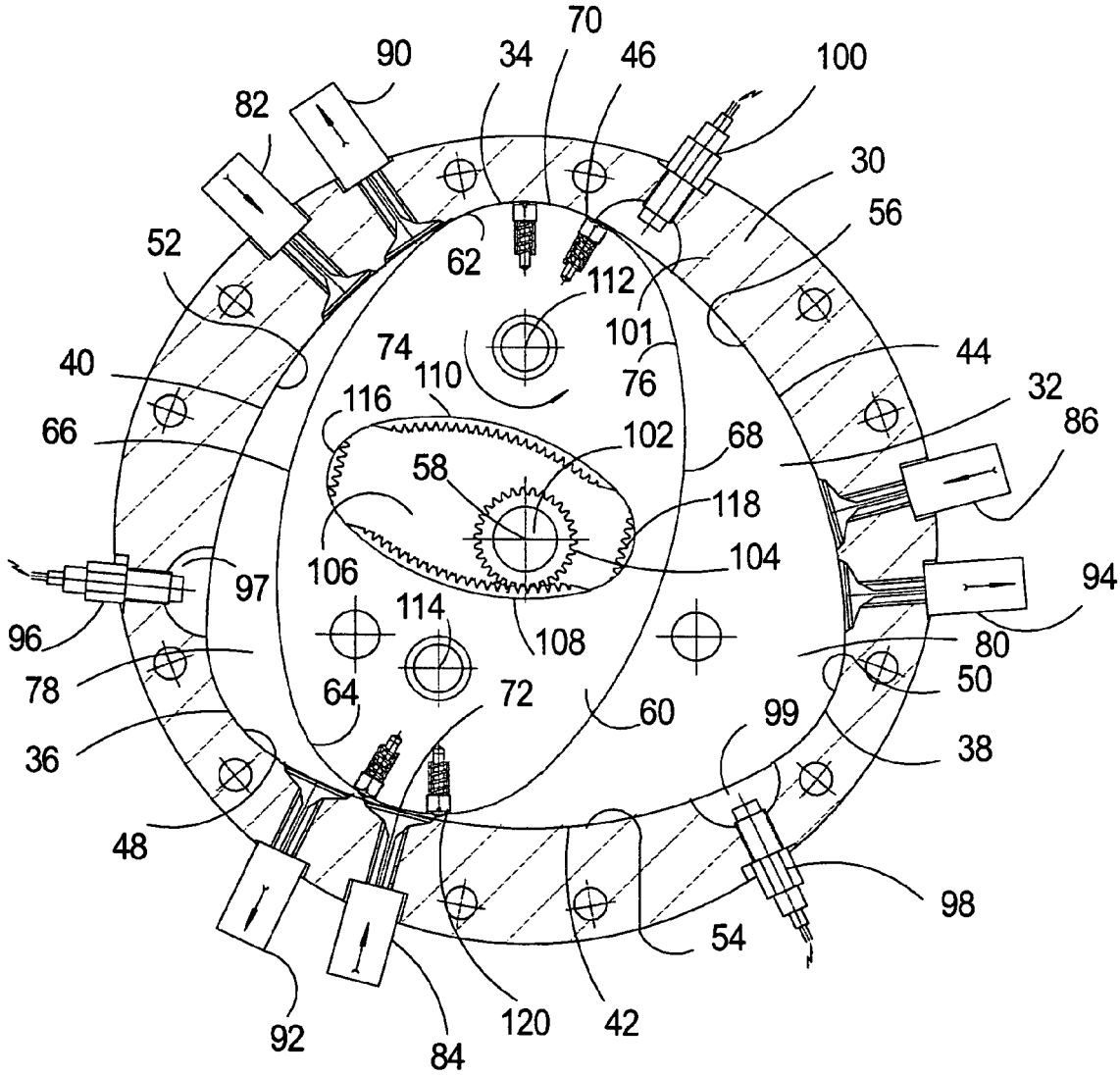
FIG. 1 shows a bi-oval rotary piston rotating in a tri-oval chamber of a housing.

In FIG. 1 the housing of a rotary piston machine is designated by 30. This housing 30 forms a prismatic chamber 32. The cross section of this chamber is an oval of third order. The cross section is composed of three circular arcs 34, 36, 38 having all three the same relatively small radius of curvature and three circular arcs 40, 42, 44 having all three the same relatively large radius of curvature. The circular arcs having a small and a large radius of curvature 34, 36, 38 and 40, 42, 44, respectively are alternating. A circular arc, for example 34 having a small radius of curvature joins a circular arc 40 having a larger radius of curvature counter clockwise in FIG. 1. A circular arc 36 of smaller radius of curvature joins the latter and so on. The circular arcs join each other continuously and smoothly differentially. Accordingly, the inner wall of the chamber is composed of cylindrical inner wall sections, that is three cylindrical wall sections 46, 48 and 50 corresponding to the circular arcs 34, 36 and 38, respectively, designated herein as "first" inner wall sections, and three cylindrical inner wall sections 52, 54 and 56, designated herein as "second" wall sections. One can see that the oval and therewith the chamber 32 has a threefold symmetry. There are three symmetry planes angularly offset by 120°. The symmetry planes intersect in an axis 58.

A rotary piston 60 is guided in the chamber 32. The rotary piston 60 is prismatic. The cross section of the rotary piston 60 is an oval of second order. This oval is composed of two circular arcs 62 and 64 of relatively small radius of curvature and two circular arcs 66 and 68 of relatively large radius of curvature. The small and large radii of curvature of the oval of the rotary piston 60 correspond to the small and large radii of curvature, respectively, of the oval of the chamber 32. Also herein, the circular arcs with small and large radius of curvature are alternating. The alternating circular arcs 62, 66, 64, 68 join each other continuously and smoothly. The prismatic rotary piston 60 comprises, in accordance with the circular arcs, cylindrical nappe sections 70 and 72 having relatively small radius of curvature and cylindrical nappe sections 74 and 76 having relatively large radii of curvature. The cylindrical nappe sections 70 and 72 are diametrically opposite. The rotary piston has a symmetry of second order: one symmetry plane extends through the cylinder axes of the diametrically opposite cylindrical nappe sections 70 and 72 of smaller radius of curvature. A second symmetry plane extends perpendicularly thereto through the cylinder axes of the cylindrical nappe sections 74 and 76 of relatively large radii of curvature.

One can see that the rotary piston 60 is guided in the chamber 32 with positive fit. In FIG. 1, the cylindrical nappe section 70 is situated in the cylindrical inner wall section 34 of the chamber 32, the nappe section 70 and the inner wall section 34 having the same radius of curvature. The cylindrical nappe section 72 engages the inner wall section 54 of the chamber 32 facing the inner wall section 34. When the rotary piston 60 is rotating, as indicated, counter clockwise in FIG. 1, the cylindrical nappe section 70 of the rotary piston is rotating in the cylindrical inner wall section 46 of the chamber 32. The diametrically opposite cylindrical nappe section 72 of the rotary piston 60 is sliding along the cylindrical inner wall section 54 of the chamber 32.

In FIG. 1, the rotary piston 60 forms two working chambers 78 and 80 in the chamber 32, which working chambers are sealed against each other by the rotary piston 60. When the rotary piston 60 rotates counter clockwise in FIG. 1, the working chamber 78 in the observed working section is increased, while the working chamber 80 is decreased.

The rotary piston machine illustrated in FIG. 1 is an internal combustion engine in which a fuel is ignited and burnt in the working chamber 78 and 80, respectively, of the rotary piston machine. Accordingly, one inlet valve 82,84 and 86, respectively for feeding the fuel, one outlet valve 90, 92 and 94 and one spark plug 96, 98, and 100 are provided in each of the cylindrical inner wall surfaces 52, 54 and 56, respectively, having the larger radius of curvature, these elements being known technology and, therefore, are illustrated only schematically and symbolically in FIG. 1. The spark plugs 96, 98 and 100 are located in combustion chamber cavities 97, 99 and 101 respectively formed in the cylindrical inner wall sections 52, 54, and 56, respectively.

The rotary movement of the rotary piston is picked-off or (when applying to a pump) initiated in the following way:

A driving or driven shaft 102 extends centrally through the chamber 32. The driving or driven shaft 102 is mounted in closure pieces of the housing 10 which are not illustrated in FIG. 1. The axis of the driving or driven shaft 102 coincides with the central axis 58. A pinion 104 is located on the driving or driven shaft 102. Instead of one single pinion, two pinions biased in known way may be provided, the pinions suppressing the game from the driving or driven system in co-operation with the counter toothing. A longitudinal aperture 106 extends through the rotary piston 60. The rotary piston 60 has an internal toothing described hereinafter. The large axis of the aperture is extending perpendicularly to the first symmetry plane of the rotary piston 60 into the second symmetry plane. The internal toothing is composed of two concave toothed racks 108 and 110 on opposite longitudinal sides of the aperture 106. The toothed racks 108 and 110 are curved about the cylinder axes of the cylindrical nappe sections 62 and 64, respectively. These cylinder axes define piston-fixed instantaneous axes of rotation 112 and 114, respectively, of the rotary piston 60. Linear toothed racks 116 and 118 are provided at the ends of the aperture 106. They may also be replaced by the convex toothing arcs.

A seal is designated by 120, which seal causes a sealing between the rotary piston 60 in the area of the cylindrical nappe sections 70, 72 and the cylindrical inner wall sections of the chamber 32. The seals 120 will be described in greater detail hereinafter.

The movement of the rotary piston 60 in the chamber 32 is explained with reference to the schematic FIG. 4. The rotary piston 60 is moving in subsequent similar intervals of movement. The rotary piston 60 is rotating alternatingly about respectively one of two instantaneous axes of rotation 112 and 114, defined by the cylinder axes of the cylindrical nappe sections 62 and 64, respectively.

Figure 4:
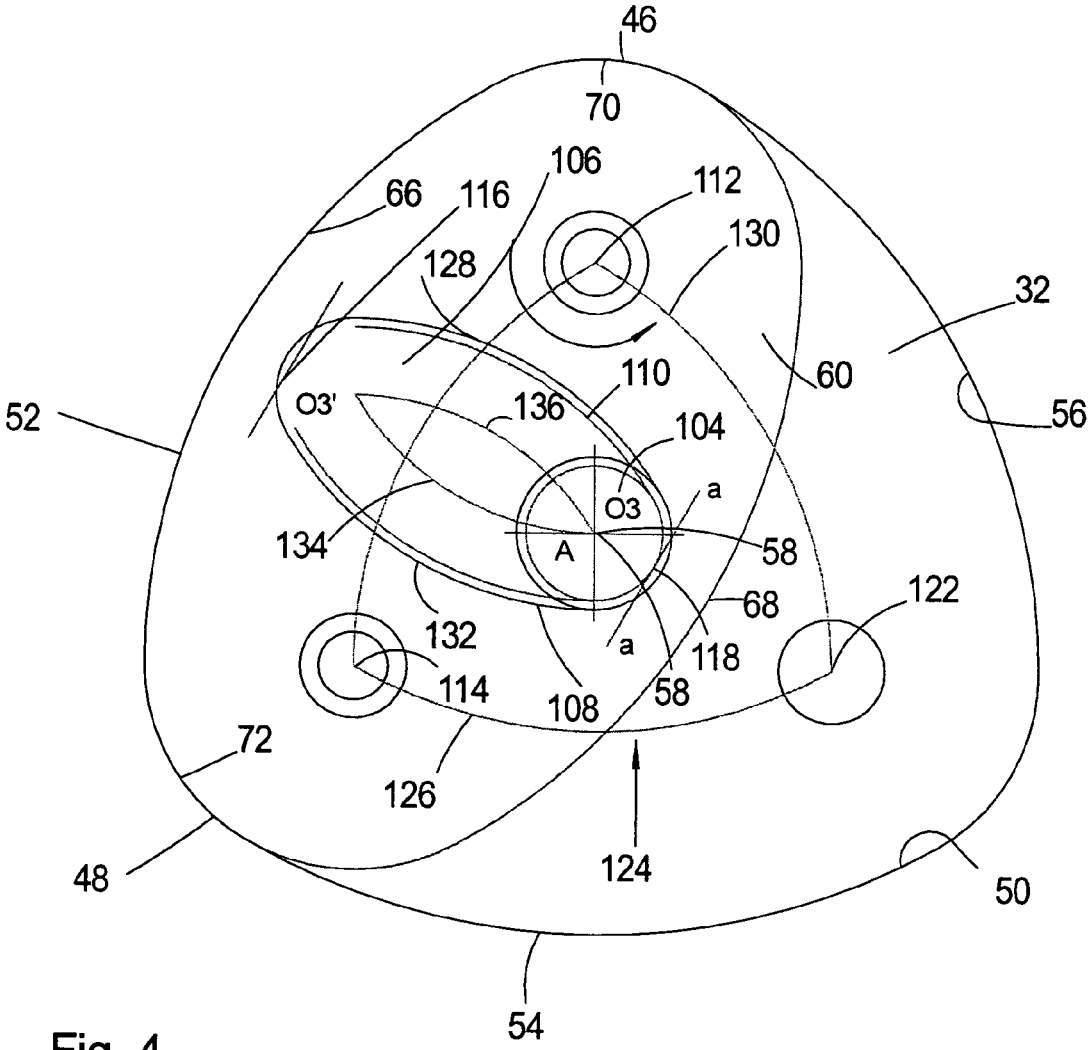
FIG. 4 shows, for an arrangement according to FIG. 1, the single trajectory of the possible axes of rotation of the rotary piston relative to the housing as well as the trajectory of the axis of the driving shaft relative to the rotary piston.

In FIG. 4, the rotary piston 60 is located, at the beginning of an interval of movement, in a position in which half of the two cylindrical nappe sections 70 and 72 of the rotary piston are in the inner wall sections 46 and 48, respectively, complementary thereto. The circular arc 66 of larger radius of curvature engages the inner wall section 52 complementary thereto. From this position, the rotary piston is rotating counter clockwise in FIG. 4 about the instantaneous axis of rotation 112. The cylindrical nappe section 70 rotates like in a bearing in the cylindrical inner wall section 46 of the chamber 32 complementary thereto. The cylindrical nappe section 72 slides to the right in FIG. 4 on the inner wall section 54. This rotation about the instantaneous axis of rotation 112 is continued until the rotary piston 60 engages the face of the chamber 32 on the right side in FIG. 4. This is a "stop position". Half of the cylindrical nappe section 72 is then located in the inner wall section 50 complementary thereto. The nappe section 68 engages the inner wall section 56. Thus, the rotary movement about the instantaneous axis of rotation 112 is limited. The described movement is an "interval of movement".

In the subsequent interval of movement, the rotary piston rotates in a similar way about the other instantaneous axis of rotation 114. In the subsequent interval of movement, this instantaneous axis of rotation 114 coincides with the cylinder axis 122 of the cylindrical inner wall section 50. The rotary piston 60 now rotates about this new instantaneous axis of rotation (122 referring to the chamber or 114 referring to the rotary piston). The nappe section 72 is rotating in the inner wall section 50, while the nappe section 70 is sliding at the inner wall section.

Thus, each interval of movement comprises a movement into a stop position followed by a jump of the instantaneous axis of rotation 112 to 114 or vice versa. FIG. 4 shows the trajectory 124 of the axis of rotation 112 or 114 not acting as instantaneous axis of rotation in an interval of movement: In the first interval of movement the axis 114 is moving on the arc 126 to the position defined by the cylinder axis 122. Then, an axis jump occurs: Now, the axis 112 rotates about the instantaneous axis of rotation 114 in the position of the cylinder axis 122 along the arc 128. In the third interval of movement, the axis 112 has reached the position of the cylinder axis of the inner wall section 48 and becomes again instantaneous axis of rotation. The axis 114 moves along the arc 130. Then, the arrangement illustrated in FIG. 4 is reached again, however, the instantaneous axes of rotation 112 and 114 having changed their position. Starting out herefrom, there are three other intervals of movement until the state of FIG. 4 is reached again. The trajectory 124 thus represents an arcuate triangle, which, however, is not passed continuously.

Figure 5:
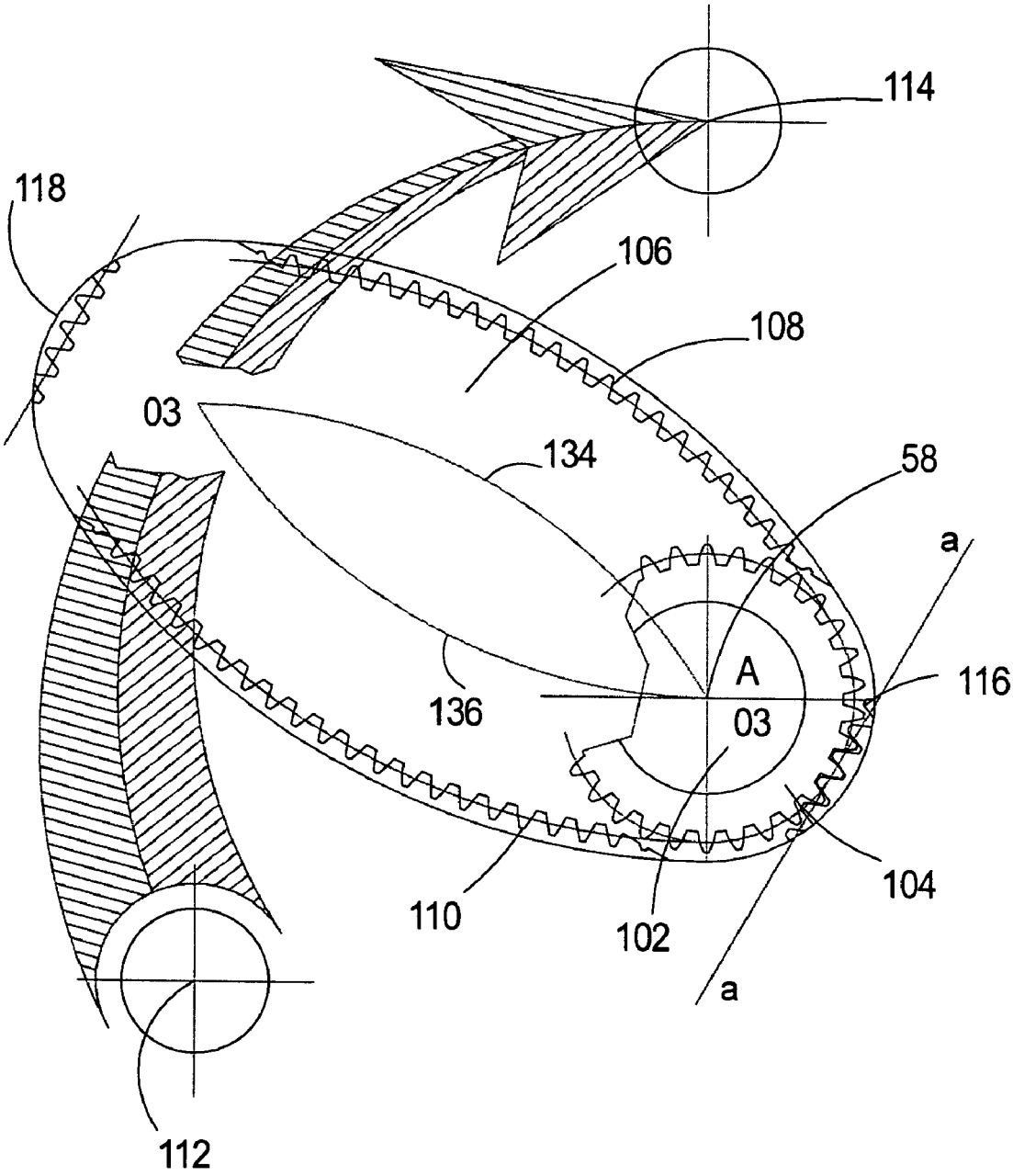
FIG. 5 shows the kinematics of the power transmission system in an arrangement according to FIG. 1 with odd toothed racks.

FIG. 4 also shows the trajectory 132 passed by these movements of the rotary piston 60 from the axis 58 of the driving or driven shaft 102 relative to the rotary piston 60 and the aperture 106. This trajectory is a twoangle, i.e. a geometric figure having two oppositely curved circular arcs meeting in two corners. The circular arcs are curved herein about the two possible instantaneous axes of rotation 112 and 114 of the rotary piston 60 and symmetrical to the "transversal" symmetry plane of the rotary piston. In the end position of FIG. 4, the transversal symmetry plane passes through the axis 58. In the "stop position", the axis 58 is located on one of the corners of the twoangle on the transversal symmetry plane. The curvature of the circular arcs depends on the position of the axes of rotation 112, 114 relative to this transversal symmetry plane and therewith on the radius of curvature of the two nappe sections 70 and 72. The toothed racks 108 and 110 are also curved about the possible instantaneous axes of rotation 112 and 114, respectively. Their distance from the two circular arcs 134 and 136, respectively, is equal to the radius of the pinion 104. In the stop position there will be a jump of the instantaneous axis of rotation from for example 112 to 114. When the rotary piston 60 is rotating during one interval of movement for example about the instantaneous axis of rotation 112, then the axis 58 of the driving or driven shaft 102 is moving on the circular arc 134 of the trajectory 132, and the pinion 104 engages the concave toothed rack 108. After having reached the stop position the instantaneous axis of rotation jumps as illustrated in FIG. 5. The rotation is now effected about the instantaneous axis of rotation 114. The axis 58 of the driving or driven shaft 102 is then in one corner of the twoangle and is moving in the next interval of movement along the circular arc 136. Correspondingly, the pinion 104 then must engage the concave toothed rack 110 curved about the instantaneous axis of rotation 114. In the stop position the circumference of the pinion must join the concave toothed racks 108 and 110 continuously and smoothly. However, the transmission of the pinion 104 from one toothed rack to the other 108 resp. 110 must be realised without blocking. This would be the case, if the toothed racks would form an oval of second order in total with the radius of curvature about the instantaneous centers of rotation and the radius of curvature of the gearwheel. For this reason, the odd or linear tooth racks 116 and 118 are provided at the ends of the aperture 106. Also convex toothed racks (toothed bars) might be provided instead of linear toothed racks 116 and 118. There are gaps between the concave toothed racks 108 and 110 and the linear or convex toothed racks 116 and 118, the pinion 104, however, just coming out of the engagement with the concave toothed rack 108 or 110, when engaging the linear or convex toothed rack 116 or 118. It can be shown that the kinematics is closed and that a safe and correct transition from one concave toothed rack to the other is ensured without interruption of the driving connection.

Figure 6:
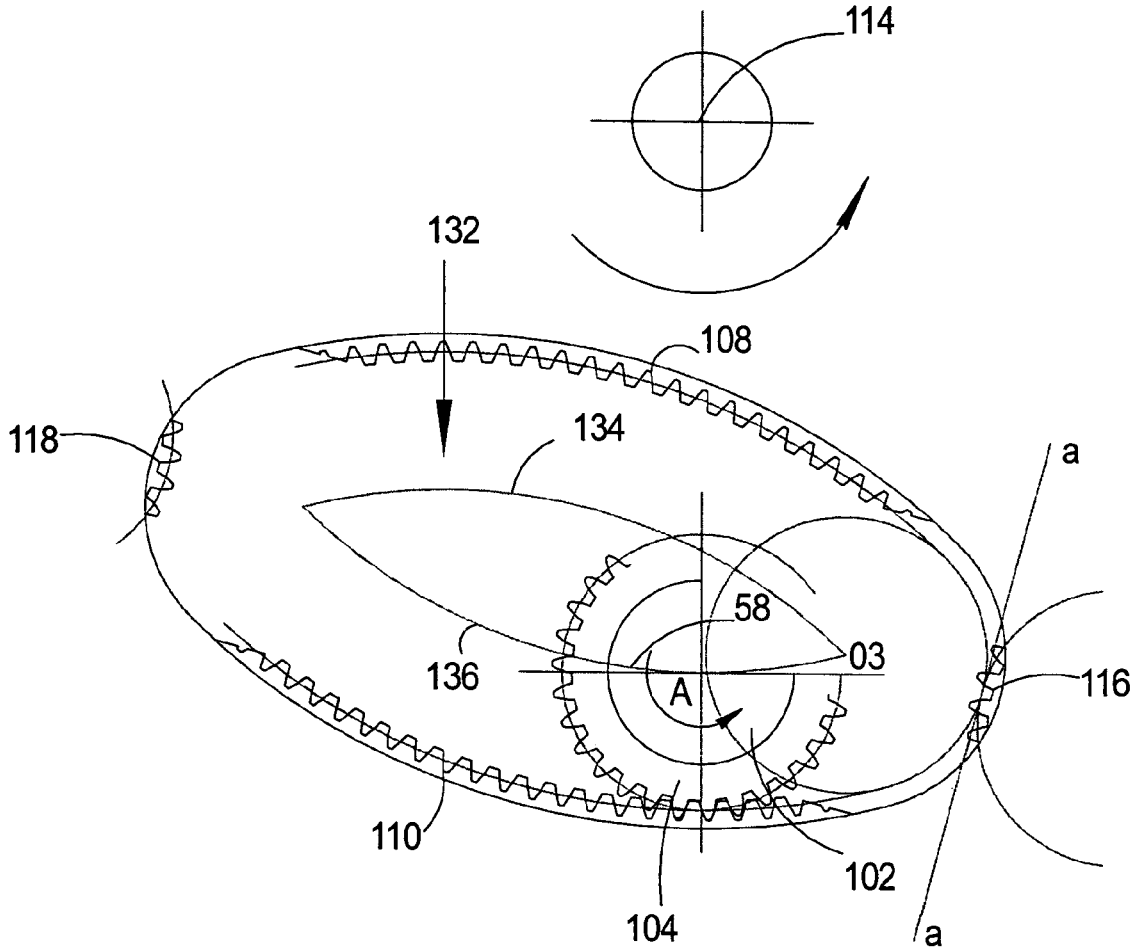
FIG. 6 shows the kinematics of the power transmission system in an arrangement of FIG. 1 at the moment shortly after leaving the stop position with convex toothed racks.

FIG. 5 shows the kinematics of the power transmission exactly in the stop position. FIG. 6 shows the power transmission shortly thereafter, when the rotation is effected about the instantaneous axis of rotation 114 and the pinion engages the concave toothed rack 110.

FIGS. 7.1 to 7.12 show the different operational phases of a rotary piston machine according to FIG. 1, operating as an internal combustion engine.

FIG. 7.1 shows the rotary piston machine in the position of FIG. 1. A working chamber 78 and a working chamber 80 are formed. The combustion takes place in the working chamber 70, i.e. fuel is introduced or injected and ignited. The combustion gases urge the rotary piston 60 counter clockwise about the instantaneous axis of rotation 112. The working chamber 78 is expanding, the working chamber 80 is reduced. The air in the working chamber 80 is compressed. This is continued until the stop position, illustrated in FIG. 7.2. The working chamber 78 has a maximum volume. The volume of the working chamber 80 is zero except for the combustion chamber cavity 101. This shall be called "first" interval of movement.

In this stop position, fuel is injected into the combustion chamber cavity 101 and ignited. The combustion gases urge the rotary piston 60 further counter clockwise now about the instantaneous axis of rotation 114. In a second interval of movement, a working chamber 140 is formed, as illustrated in FIG. 7.3. This working chamber 140 expands. Thus, the working chamber 78 on the other side of the rotary piston 60 is reduced. The combustion gases are pressed out as waste gas. The working chamber 140 increases in the second interval of movement until the second stop position is reached, which is shown in FIG. 7.4. Then, the working chamber 140 has its maximum volume. The volume of the working chamber 78 is practically zero.

In the third interval of movement, the instantaneous axis of rotation jumps again from 114 to 112. With further rotation of the rotary piston 60 counter clockwise, a new working chamber 142 is formed. Air is drawn into this working chamber 142. The combustion gases are pressed out as waste gases out of the opposite working chamber 140 again reduced during the third interval of movement. This is illustrated in FIG. 7.5. The third interval of movement ends in the stop position illustrated in FIG. 7.6. In this stop position, the volume of the working chamber 142 has reached the maximum, the volume of the working chamber 140 is practically zero.

A fourth interval of movement illustrated in FIG. 7.7 and FIG. 7.8 is geometrically similar to the first interval of movement. However, the rotary piston 60 is now rotating about the piston-fixed instantaneous axis of rotation 114. A working chamber 114 is formed in this fourth interval of movement, which working chamber is expanded with rotation of the rotary piston 60. Air is drawn into this working chamber 144. The air drawn in the third interval of movement into the working chamber 142 is compressed when the working chamber 142 is reduced. In the stop position illustrated in FIG. 7.8, the volume of the working chamber 144 has reached the maximum and the volume in the working chamber 142 is practically zero. The air earlier drawn-off is compressed in the combustion chamber cavity 101. In this stop position of FIG. 7.8, fuel is again introduced or injected into the combustion chamber cavity 101 and ignited.

In a fifth interval of movement, illustrated in FIGS. 7.9 and 7.10, the rotary piston is again rotated about the instantaneous axis of rotation 112. A working chamber 146 is formed, in which chamber the combustion gases expand and urge the rotary piston 60 further counter clockwise. The working chamber 144 is reduced and the air drawn-off during the fourth interval of movement is compressed. Fuel is injected into the compressed air in the combustion cavity 99 of the working chamber 144 and ignited. The instantaneous axis of rotation jumps again from the axis of rotation 112 to the axis of rotation 114.

In a sixth interval of movement illustrated in the FIG. 7.11 and FIG. 7.12, an expanded working chamber 148 is formed. The combustion gases expand in the working chamber 148 and urge the rotary piston 60 about the rotary axis 114 into the position of FIG. 7.12. The combustion gases in the newly decreased working chamber 147 146 are pressed out as waste gases. In FIG. 7.12 the rotary piston 60 is again in the same position (with the axis of rotation 112 "at the top") as at the beginning of the first interval of movement. The cycle is then restarted.

"Working strokes" of the 4-cycle version are illustrated in the FIGS. 7.1 and 7.3 and in the FIGS. 7.9 and 7.11. Each working stroke is associated with a suction stroke, a compression stroke and a outlet stroke after the working stroke. Four out of eight intervals of movement comprise a "working stroke".

The instantaneous axis of rotation of the rotary piston 60 is not clearly kinematically identified in the stop positions. Temporarily, the two axes of rotation 112 and 114 are equal. The kinematics is not closed yet. If the fuel is injected and ignited or a working medium as hydraulic oil or vapour is introduced during this stop position, as it is shown for example in FIG. 7.8, a force transverse to the connection plane S-N of the rotary piston 60 acts upon the surface of the rotary piston 60 on the right in FIG. 7.8. This force may press the rotary piston 60 to the left into the generally triangular working chamber 144. The rotary piston 60 may then jam between the inner wall sections 52 and 54. This is particularly true for slow rotations, in which the further clockwise rotary movement is not already ensured by the rotary momentum of the rotary piston 60.

In order to avoid such jamming, fixing means are provided, which fixing means fix one of the two possible instantaneous axes of rotation 112 and 114, namely, in the stop position of the rotary piston 60, the one acting in the following interval of movement as instantaneous axis of rotation. In the mentioned case of FIG. 7.8, this would be the axis of rotation 112. This piston-fixed axis of rotation 112 is temporarily fixed in a position in which it coincides with the housing-fixed cylinder axis of the inner wall section 50. When the rotary piston 60 has made a certain rotation about this fixed axis, then it is ensured that the rotary piston 60 will further rotate clockwise about the instantaneous axis of rotation 112. Then, the fixing may be released. The fixing of the instantaneous axis of rotation has, of course, to be released before the rotary piston 60 has reached its next stop position, that is before the end of the interval of movement.

Figure 16:
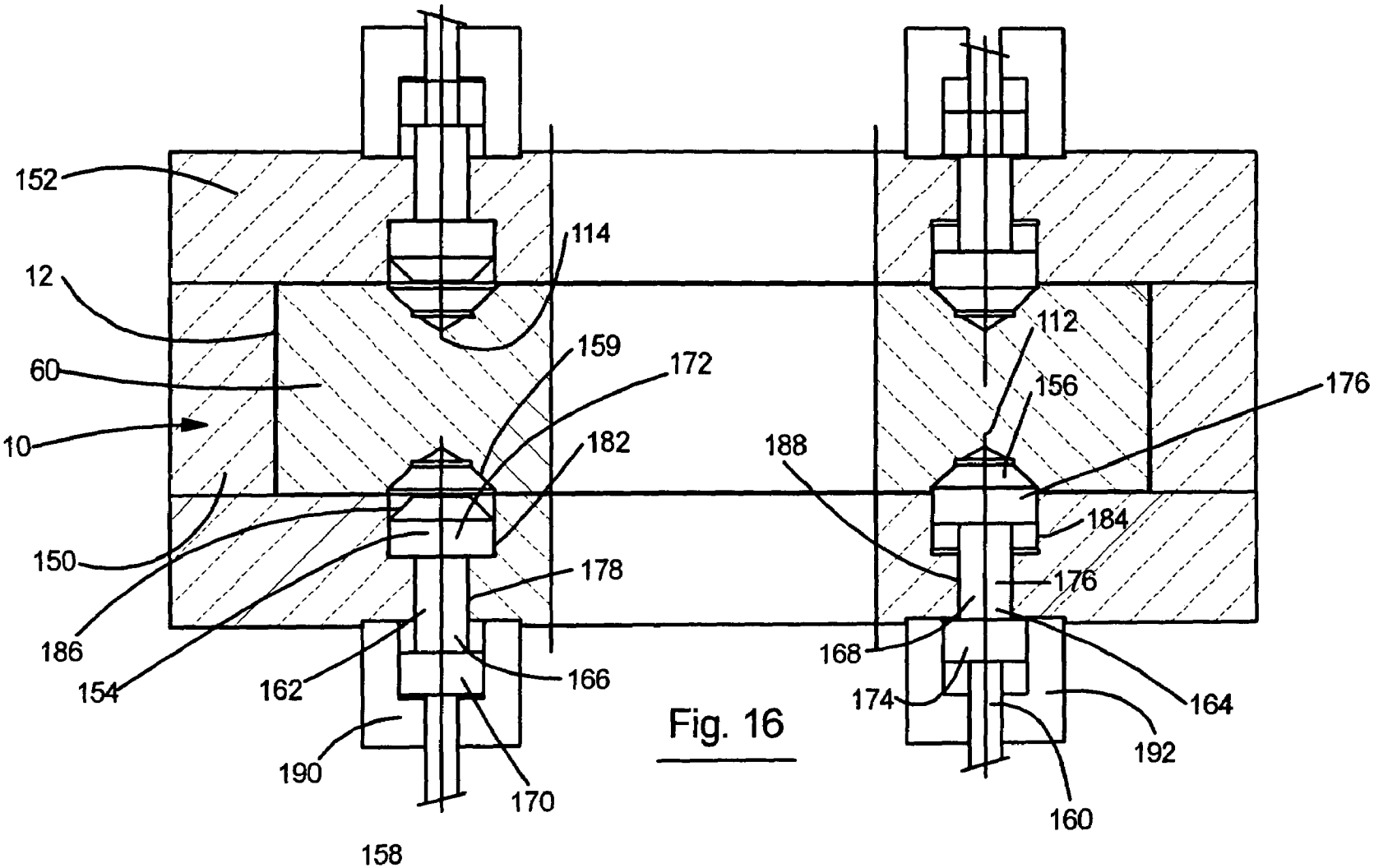
FIG. 16 schematically shows a design embodiment of the fixing means for temporarily fixing one instantaneous axis of rotation respectively in the stop position when the rotary piston is changing the intervals of movement.

A mechanical device for temporarily fixing an instantaneous axis of rotation 112 or 114 is schematically illustrated in FIG. 16 in a longitudinal section along the line S-N of FIG. 7.8.

In FIG. 16 the housing 10 with a chamber 12 is illustrated in a longitudinal section. The housing comprises a nappe portion 150 defining the chamber 12 and closure pieces 152 and 154. The rotary piston 60 is movable in the chamber 12. In FIG. 16, the possible instantaneous axes of rotation are designated by 112 and 114.

Conical recesses 156 and 158, respectively, are provided on the end face of the rotary piston 60 on the two possible axes of rotation 112 and 114. Shafts are mounted in the closure piece 154 coaxial to the cylinder axes of the cylindrical inner wall sections 46, 48 and 50, only two shafts 158 and 160 being illustrated in FIG. 16, the axes of which shafts coincide with the cylinder axes of the inner wall sections 46 and 50, respectively. The shafts 158 and 160 are axially movably guided. Heads 162 and 164, respectively, are located on the shafts. The heads 162 and 164 are coil-shaped with a central portion 166 and 168, respectively, of reduced diameter and two spaced discs 170, 172 and 174, 176, respectively, of larger diameter. The central portions 166 and 168 are guided in bores 178 and 180, respectively, of the closure piece 154. The bores 178 and 180 end in enlarged sections 182 and 184, respectively, in which are guided the chamber-side discs 172 and. 176. respectively. The chamber-side discs 172 and 176 are provided with conical surfaces 186 and 188, respectively, which can be moved into engagement with the inner surfaces of the conical recesses 156 and 158, respectively. The shaft-side outer discs 170 and 174 form armatures for the control solenoids 190 and 192, respectively. The heads 162 and 164 are movable by the control solenoids between two positions. In one position on the left in FIG. 16, the chamber-side disc 172 is located within the enlarged section 182 of the bore. In the other position on the right in FIG. 16, the outer disc 174 engages the outer face of the closure piece 154. Then, the conical surface 188 of the head engages the conical recess 156 of the rotary piston 60.

The control solenoids 190 and 192 are controlled by a (non illustrated) sensor arrangement responding to the rotation of the driving or driven shaft 102. The control solenoids are energised each time, when a stop position is reached, in which the instantaneous axis of rotation jumps from the axis of rotation 112 to the axis of rotation 114 or vice versa, such that the axis of rotation is temporarily fixed for the consecutive interval of movement. In the case of FIG. 7.8, this is the axis of rotation 112. This one is mechanically determined, as illustrated in FIG. 16 in that the head 164 engages the conical recess 156 of the rotary piston 60. Thereby, the rotary movement according to FIG. 7.9 is ensured. Jamming of the rotary piston 60 is avoided.

Figure 17:
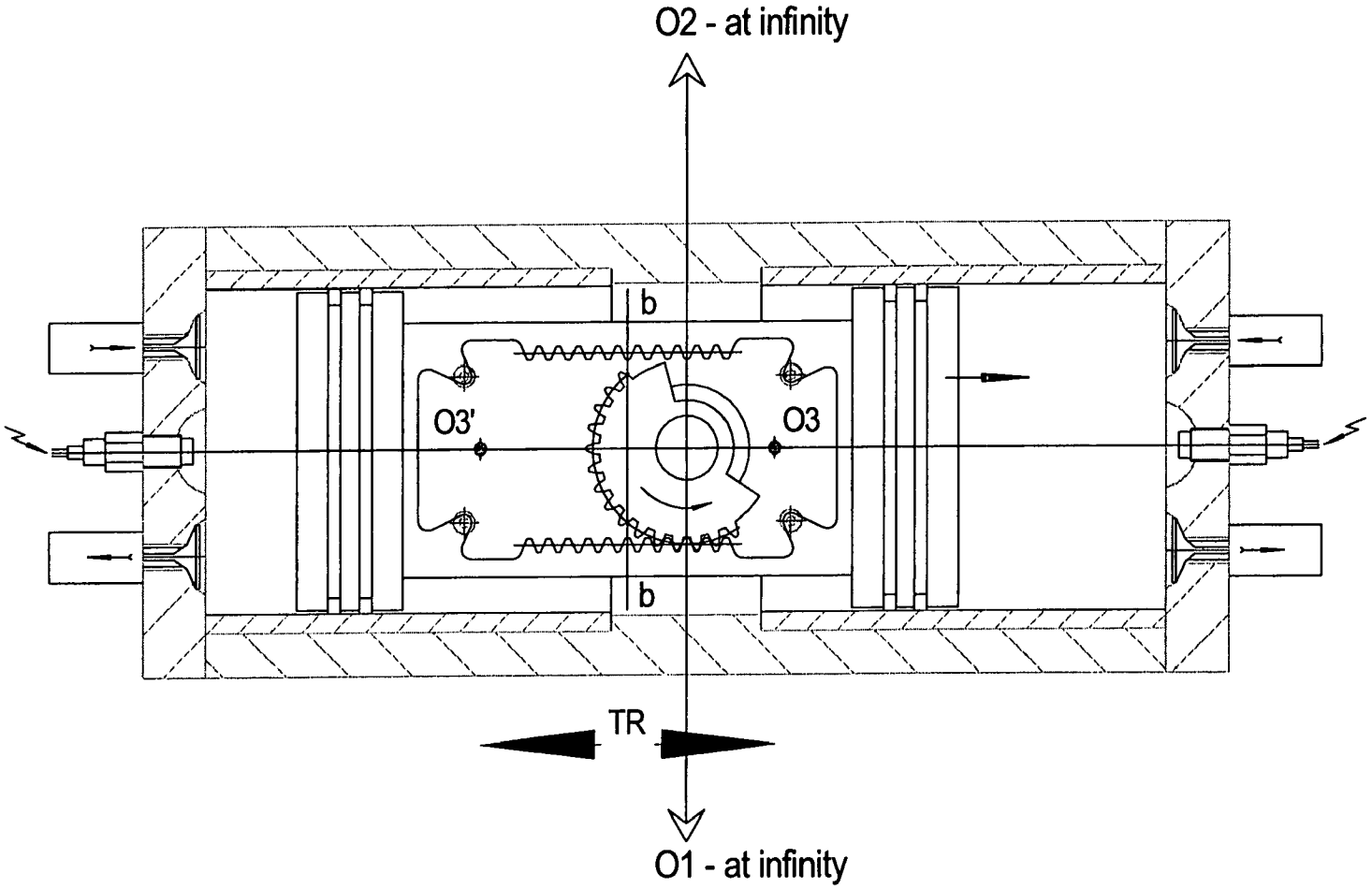
FIG. 17 schematically shows a slide valve control for controlling the pressure of the seals against the inner wall of the housing.

Longitudinal grooves 200 are provided in the cylindrical nappe sections 70 and 72, as illustrated in FIG. 17. Seals 120 are located in the longitudinal grooves 200. The seals 120 are under the action of compression springs 204 and are urged against the inner wall of the chamber 12. Thereby an additional sealing between the rotary piston 60 and the inner wall of the chamber 12 shall be obtained. Additionally, pressure from one of the working chambers may be applied to the seals, which pressure is introduced into the longitudinal grooves 200 and urges the seals 120 against the inner wall of the chamber 12. Such a pressure force improves the sealing effect, but causes increased friction, having a negative impact on the degree of efficiency and the wear. For this reason, the working chamber pressure is applied through a valve assembly 206 to the longitudinal grooves, the pressure difference between the working chambers for example 78 and 80 being applied to the valve assembly. If the pressure difference is large, the seals are urged against the inner wall of the chamber 12 with a bigger force than in case of a small pressure difference. Thus, a better sealing is achieved with large pressure difference between the working chambers, while accepting increased friction, whereas with small pressure difference a less strong pressure of the seals 120 is sufficient and friction is reduced.

Figure 20:
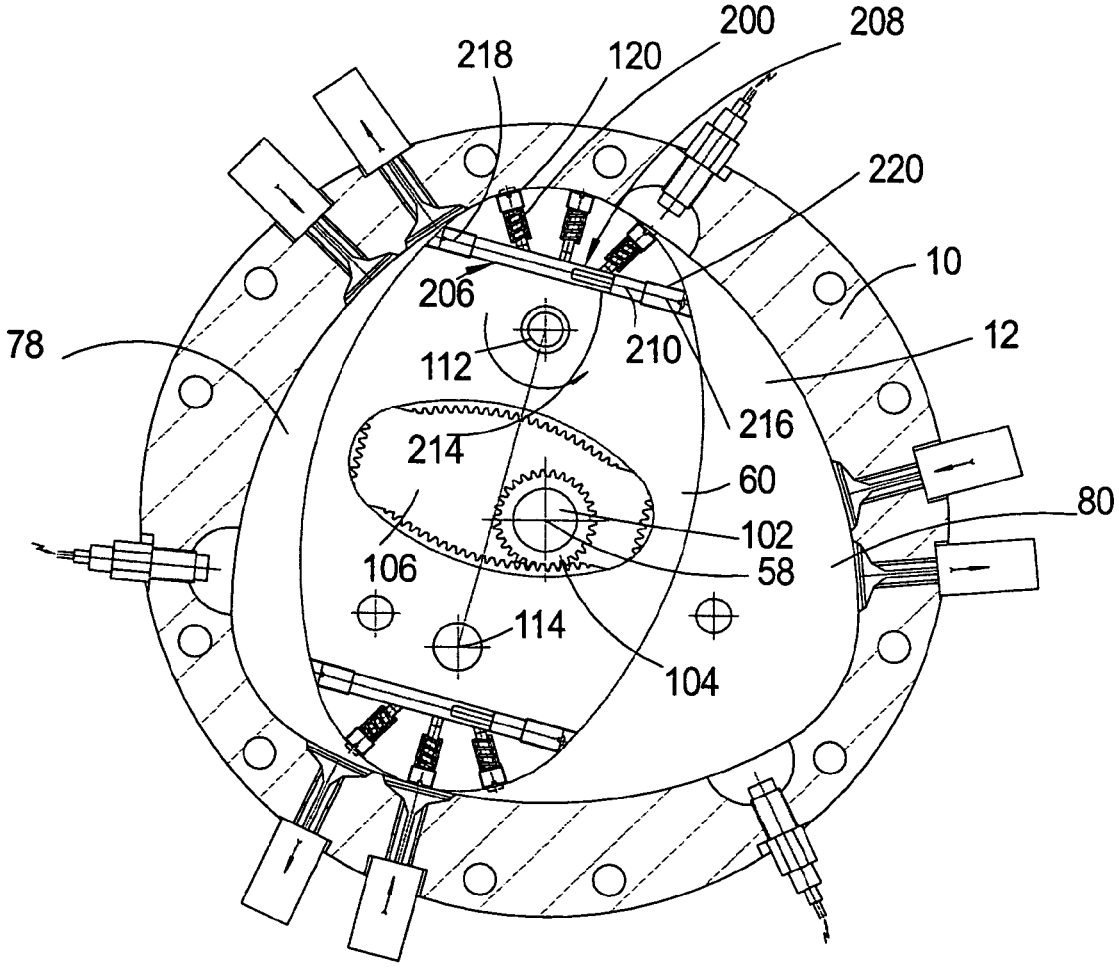
FIG. 20 shows the rotary piston machine of FIG. 1 with the valve assembly for pressing the seals.

In FIGS. 17 and 20, the valve assembly 206 comprises a bore 208 extending transversally through the rotary piston 60 and connecting the working chambers, for example 78 and 80. A slide valve 210 is guided in the bore 208. The slide valve 210 has a central portion 212 the diameter of which is adapted to the diameter of the bore 208. Reduced diameter sections 214 and 216 are located on both ends of the central portion 212. The bore is closed by sleeve-shaped closure pieces 218 and 220, respectively, in the direction of the working chambers 78, 80. The reduced diameter sections 214 and 216 can engage the bores of the sleeve-shaped closure pieces 218 or 220 and close them.

The slide valve 210 is centered by non illustrated means such that with low pressure difference between the working chambers 78, 80 it covers the connection to the longitudinal grooves 200. When the pressure difference between the working chambers exceeds a determined measure, the slide valve 208 is moved by the pressure difference in one of its end positions, in which the respective section 214 or 216 engages the associated closure piece. Then, a connection between the working chamber with higher pressure and the longitudinal groove 200 is established.

It would be desirable that the profile of the seals is adapted to the respective curvature of the inner wall section adjacent the seal. Then the seal would have a surface contact with the inner wall section with lower surface pressure and better sealing effect, as it would be the case if the seal and the inner wall section had different radii of curvature and correspondingly had only line contact. However, the inner wall sections to which the seals have consecutively contact, have either the smaller first or the larger second radius of curvature.

Figure 18:
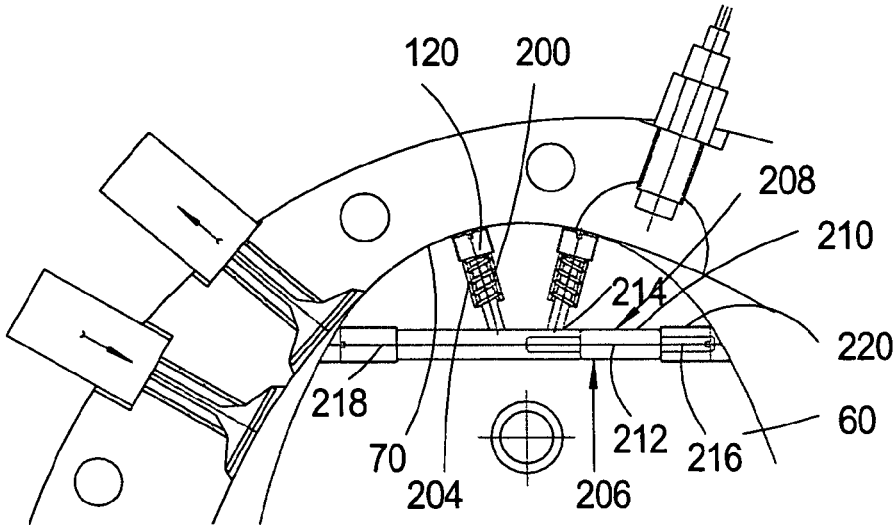
FIG. 18 schematically shows an arrangement of seals the profile of which are alternatingly adapted to the radii of curvature of the alternating inner wall sections of the chamber.

This problem is solved in an assembly according to FIG. 18 in that there are provided two types of seals, namely 222 and 224, one of which has a profile adapted to the inner wall sections 46, 48, 50 (FIG. 1) with smaller radius of curvature, thus having the same radius of curvature than those, and the other type of seal has a profile adapted to the inner wall sections 52, 54, 56 with larger radius of curvature. The two types of seals are provided alternatingly in longitudinal grooves in cylindrical surfaces 70 and 72, for example, all in all three seals 222 and two seals 224. Seals 222 with smaller radius of curvature form, in circumferential direction, the beginning and the end of the group of seals. Thus it is ensured that with contact to the cylindrical nappe sections 70 or 72 at least two seals engage each inner wall section, which seals have a radius of curvature equal to the radius of curvature of the inner wall section.

Figure 19:
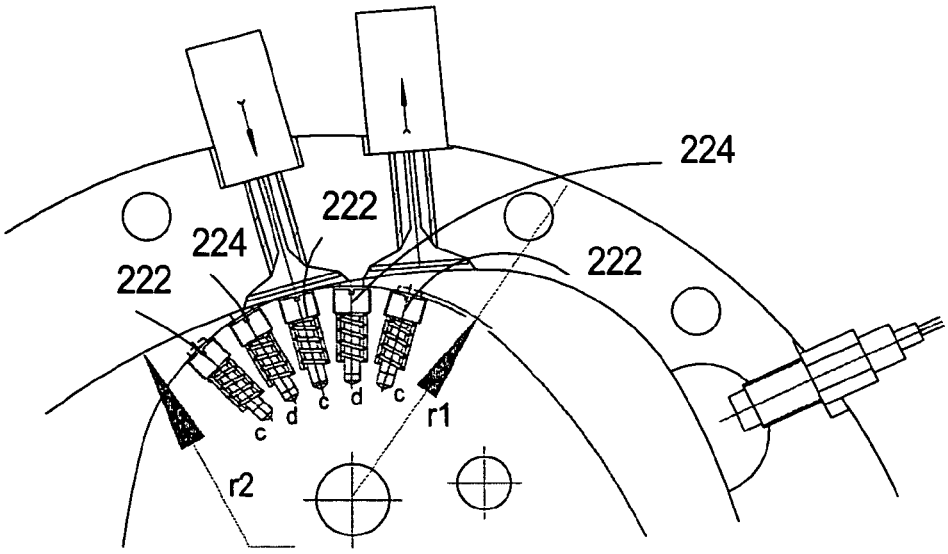
FIGS. 19A and B show a modified embodiment of the seals, in which each seal in outer longitudinal strips is adapted to the radius of curvature of the inner wall sections having a relatively small radius of curvature and in which each seal in interposed longitudinal strips is adapted to the radius of curvature of the inner wall sections having relatively large radius of curvature.
Figure 19B:
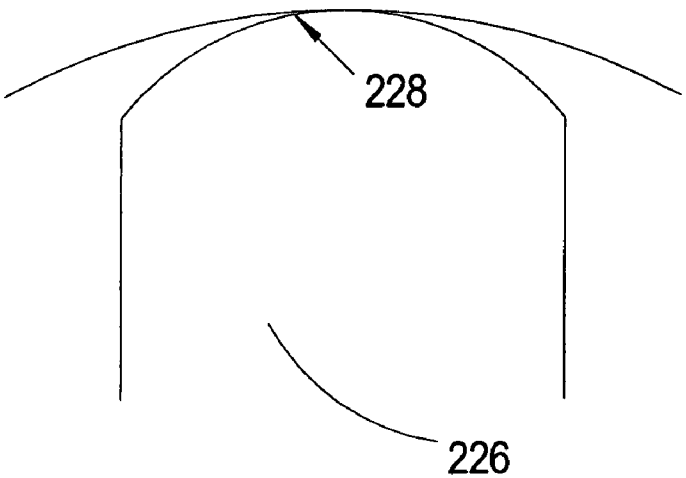
Figure 19A:
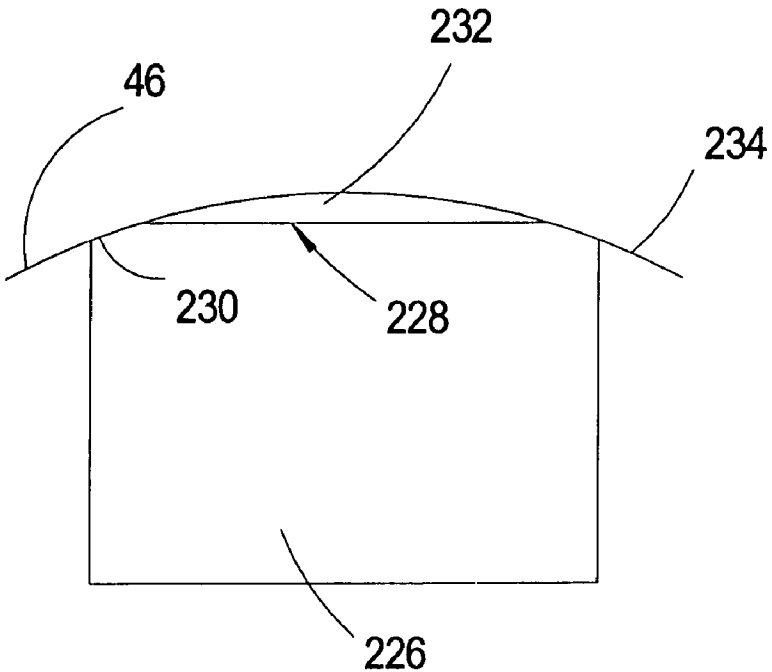

Another solution is shown by FIGS. 19A and 19B. Therein, a seal 226 is shown, the seal having a convex profile 228. The profile 228 is subdivided into three notional longitudinal strips 230, 232 and 234. The radius of curvature of the profile in the two outer longitudinal strips 230 and 234 is equal to the smaller radius of curvature of the inner wall sections 46, 48, 50. The radius of curvature of the profile in the central longitudinal strip 232 is equal to the larger radius of curvature of the inner wall sections 52, 54, 56. When the seal 226 engages an inner wall section 46, 48, 50 with smaller radius of curvature the two outer longitudinal strips 230 and 234 are in surface contact with the inner wall section, for example 46. This is illustrated in FIG. 19A. When the seal 226 engages an inner wall section 52, 54, 56 with larger radius of curvature, then the seal in the central longitudinal strip 232 has surface contact with the inner wall section, for example 52.

Figure 2:
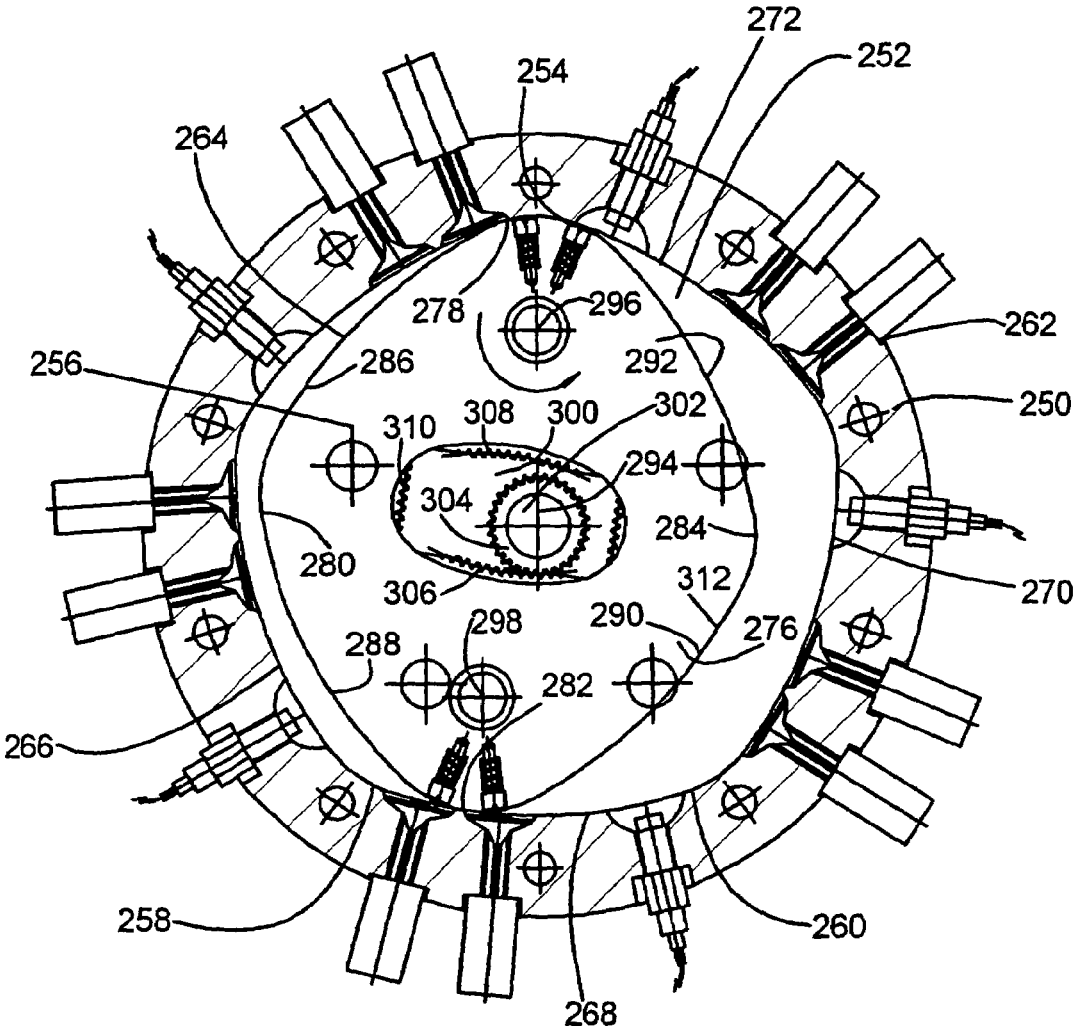
FIG. 2 shows a quarto-oval rotary piston rotating in a pent-oval chamber of a housing.

FIG. 2 shows a rotary piston machine in which the cross section of a chamber 252 formed in a housing 250 is an oval of fifth order. The inner wall of the chamber 252 comprises five cylindrical inner wall sections 254, 256, 258, 260 and 262 of smaller radius of curvature and five cylindrical inner wall sections 264, 266, 270, 272 and 274 of larger radius of curvature, alternating therewith. The expression "cylindrical" shall mean herein that they are sections of a cylindrical surface. The inner wall sections with smaller or larger radius of curvature join each other continuously and smoothly, i.e. with a common tangent in the connection points of the cross section. A rotary piston 276 is movable in the chamber 252. The cross section of the rotary piston 276 is an oval of fourth order. The nappe surface of the rotary piston 276 comprises four cylindrical nappe sections 278, 280, 282, and 284 of smaller radius of curvature and four cylindrical nappe sections 286, 288, 290 and 292 of larger radius of curvature, alternating therewith. Also herein, the nappe sections with smaller or larger radius of curvature join each other continuously and smoothly, i.e. with a common tangent in the connection points of the cross section. The smaller and larger radii of curvature of the rotary piston 276 are again equal to the smaller or larger, respectively, radii of curvature of the chamber 252.

The chamber 252 has a fivefold symmetry, i.e. there are five symmetry planes extending through the cylinder axis of an inner wall section of smaller radius of curvature and the cylinder axis of the opposite inner wall section of larger radius of curvature. The symmetry planes intersect in a center axis 294. The rotary piston 276 only has a twofold symmetry: the two symmetry axes pass on the one hand through the cylinder axes of the opposite cylindrical nappe surfaces 278 and 278 and on the other hand through the cylinder axes of the opposite cylindrical nappe sections 280 and 284.

Similarly to the rotary piston machine of FIG. 1, two possible instantaneous axes of rotation 296 and 298 are defined at the rotary piston 276. These axes of rotation 296 and 298 are the cylinder axes of the cylindrical nappe sections 278 and 282, respectively, and are located on a first symmetry plane of the rotary piston 276.

The rotary piston 276 comprises, similarly to the rotary piston machine of FIG. 1, a bi-oval central aperture 300. The longer axis of the aperture extends into the second symmetry plane of the rotary piston 276. The shorter axis is located in the mentioned first symmetry plane. A driving or driven shaft 302 extends along the center axis 294. A pinion 304 is located on the driving or driven shaft 302. The pinion 304 engages respectively one of two concave arcuate toothed racks 306 and 308. The toothed rack 306 is curved about an instantaneous axis of rotation 298. The toothed rack 308 is curved about the instantaneous axis of rotation 298. Linear toothed racks 310 and 312 are located at the ends of the aperture 300. They may be replaced by convex toothed arcs.

This assembly operates in general in the same way as the corresponding assembly of FIG. 1 and establishes a driving connection between the rotary piston 276 and the driving or driven shaft 302.

The rotary piston is rotating in the chamber 252 counter clockwise in general in the same way as described for the embodiment of FIG. 2: In consecutive intervals of movement the rotary piston is rotating about one of the two possible instantaneous axes of rotation, for example with the cylindrical nappe section 278 in the cylindrical inner wall section 254 about the axis of rotation 296, the nappe section 282 sliding at the inner wall section 258. When the stop position is reached, the axis of rotation is changed.

Figure 8:
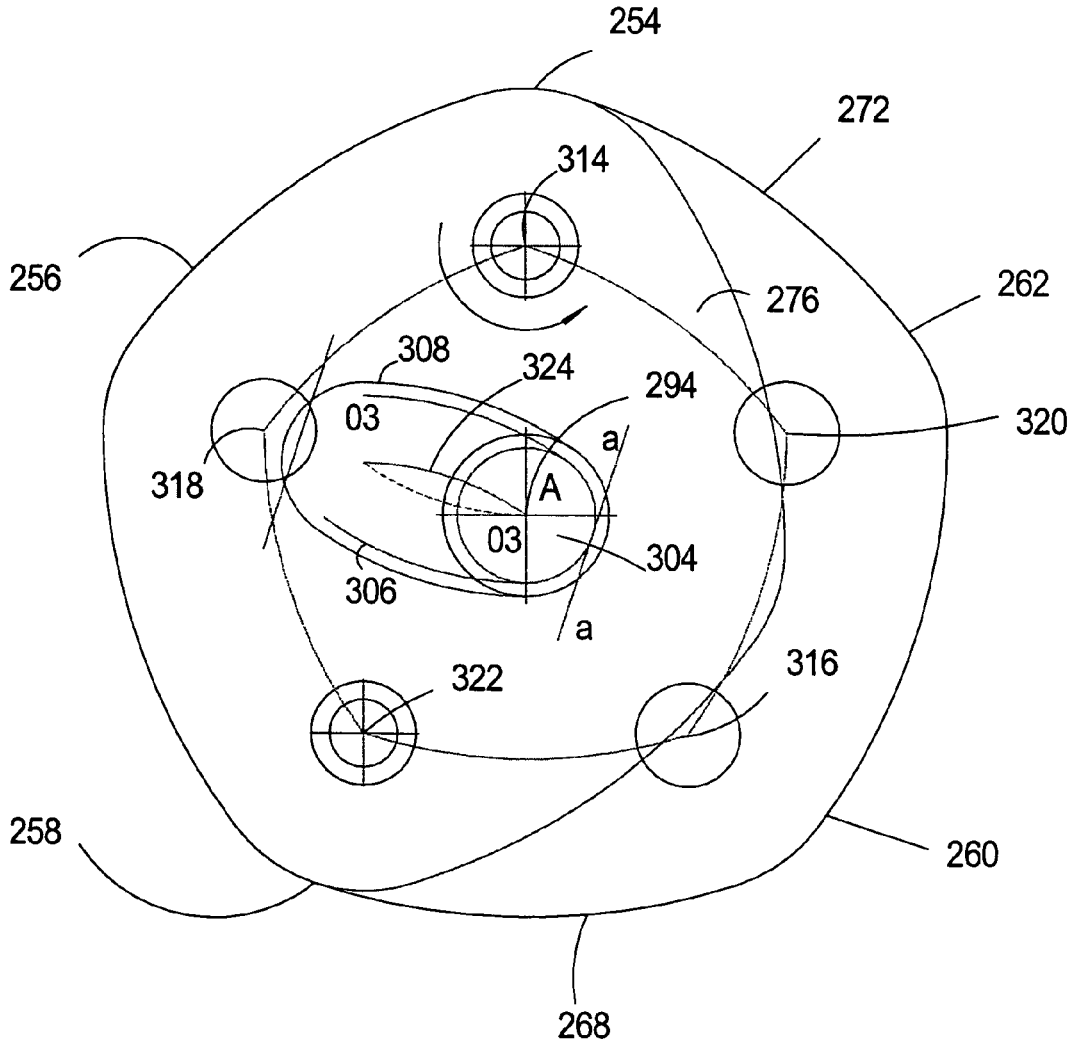
FIG. 8 shows for the arrangement according to FIG. 2, the single trajectory of the possible axes of rotation of the rotary piston relative to the housing as well as the trajectory of the axis of the driving or driven shaft relative to the rotary piston.

The rotary piston 276 rotates with relative to the chamber 252 consecutively about the chamber-fixed axes of rotation 314, 316, 318, 320 and 322 (FIG. 8). These axes are again defined by the cylinder axes of the cylindrical inner wall sections 254, 260, 256, 262 and 258, respectively. The center axis 294 passes through a trajectory 324 in the form of a two-angle relatively to the rotary piston 276. The pinion 304 alternatingly meshes with the concave toothed rack 306 or 308, depending on the rotary piston 276 rotating about the instantaneous axis of rotation 296 or about the instantaneous axis of rotation 298 of the rotary piston 276. This is similar to FIG. 4.

Figure 9:
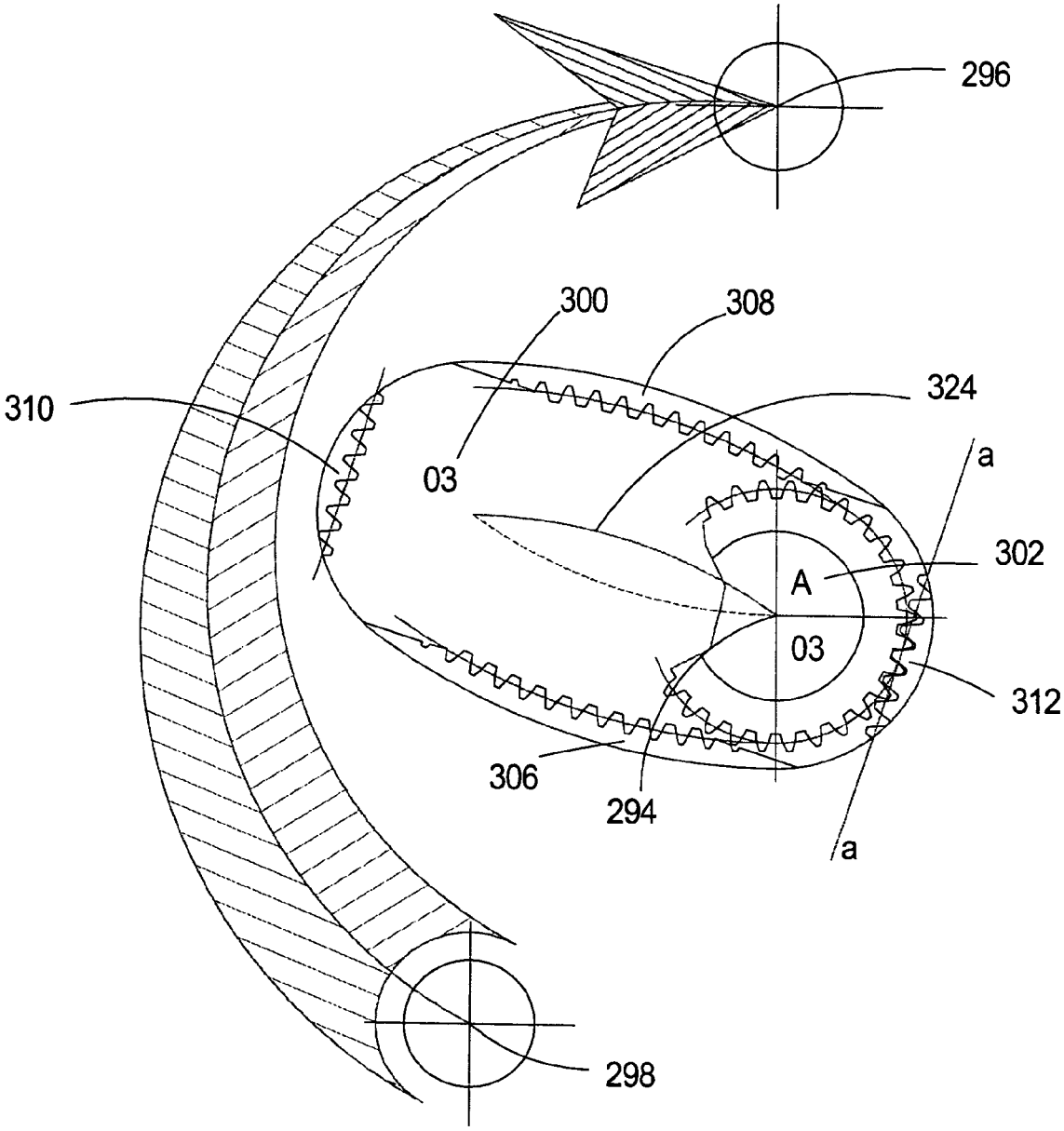
FIG. 9 shows similarly to FIG. 5, the kinematics of the power transmission system in the arrangement of FIG. 2 with the toothed bars.
Figure 10:
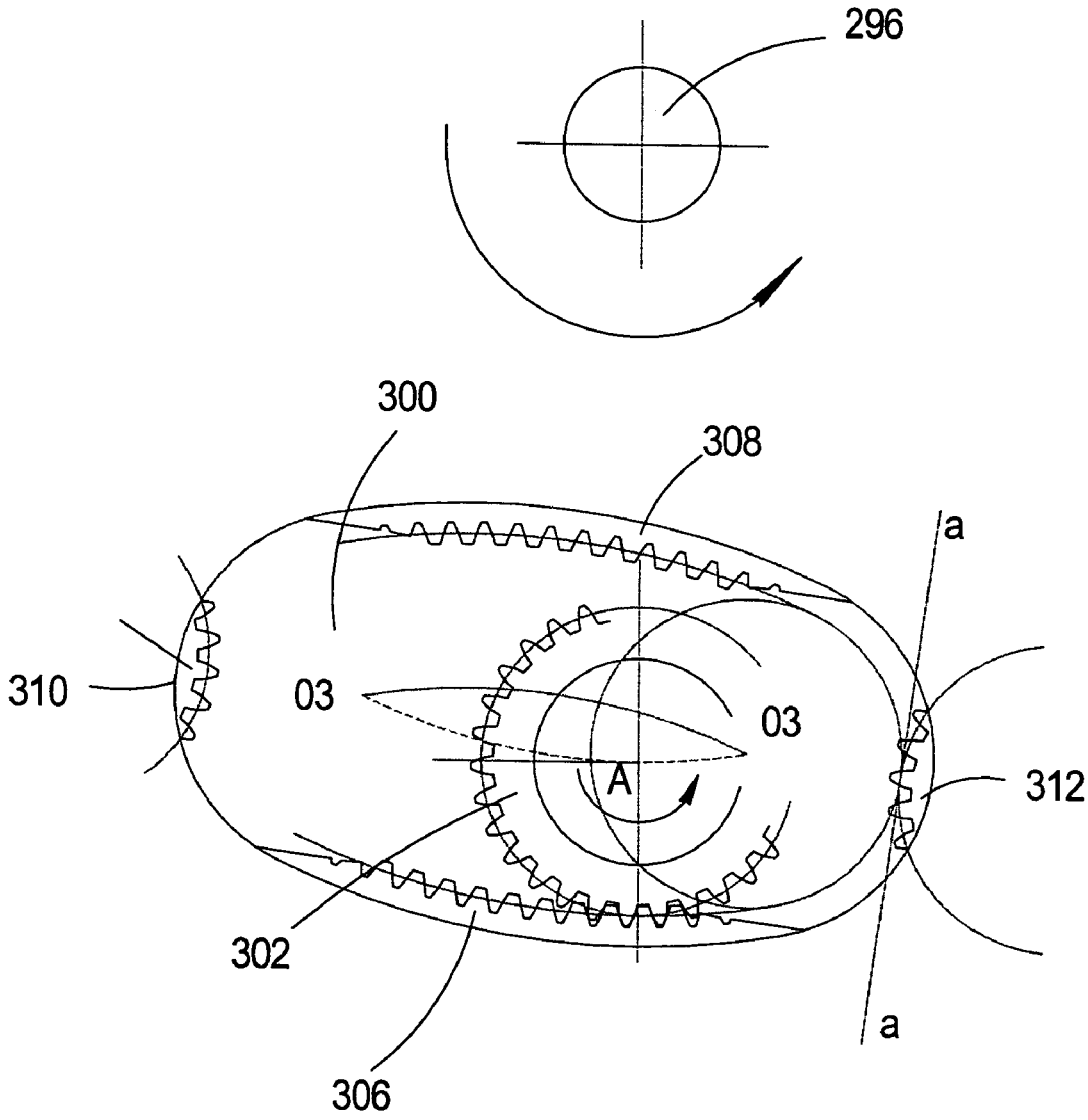
FIG. 10 shows the kinematics of the power transmission system in the arrangement of FIG. 2 similarly to FIG. 6, a the moment shortly after leaving the stop position with the convex toothed arcs.

FIGS. 9 and 10 show, for the assembly of FIG. 2, the change of the instantaneous axes of rotation from the axis of rotation 298 to the axis of rotation 296 and the corresponding transmission of the pinion 302 from the concave toothed rack 308 to the toothed rack 306. This is analogous to FIGS. 5 and 6 except for the slightly different shape of the oval aperture.

In the stop positions of the rotary piston, the kinematics is again not closed, and the instantaneous axis of rotation is not exactly identified. The same problems arise as already described for the rotary piston machine of FIG. 2, namely that the rotary piston 276 for example in the position of FIG. 8 is not moved into further rotation by pressure in the working chamber but is pressed transversally to its first symmetry plane between the inner wall sections 268 and 272 and jams therein. This problem is again solved by the construction illustrated in FIG. 16, by which the instantaneous axes of rotation of the rotary piston are temporarily fixed consecutively in the chamber-fixed axes of rotation 314, 316, 318, 320 and 322 when the stop positions are reached.

The FIGS. 11.1 to 11.20 show in similar form as the FIGS. 7.1 to 7.12 the moving process of the rotary piston 276 during a complete revolution, the formation of working chambers, the intake and compression of air, the introduction and ignition of fuel and the expelling of the combustion gases.

It can be seen that a complete revolution of the rotary piston 276 comprises six working strokes with introducing, igniting and combustion of fuel, an suction and a compression stroke and after each working stroke an exhaust stroke being again associated with each working stroke.

Figure 3:
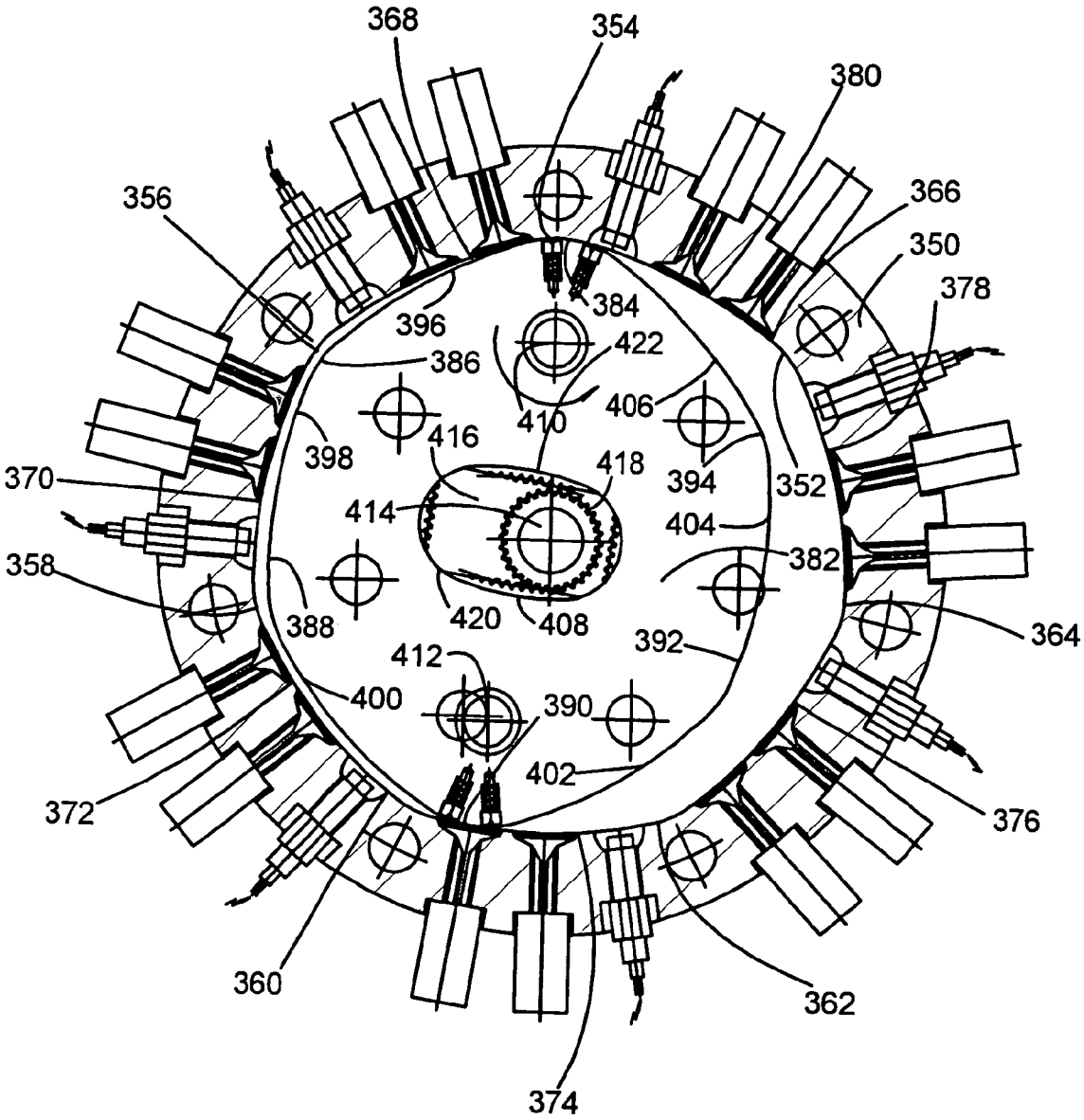
FIG. 3 shows a sext-oval rotary piston rotating in a sept-oval chamber of a housing.

FIG. 3 shows an embodiment in which a chamber 352 is formed in a housing 350, the cross section of the chamber being an oval of seventh order. The inner wall of the chamber 352 has seven concave cylindrical inner wall sections 354, 356, 358, 360, 362, 364 and 366 of relatively small radius of curvature alternating with seven concave cylindrical inner wall sections 368, 370, 372, 374, 376, 378 and 380 of relatively large radius of curvature. The alternating inner wall sections with smaller and larger radii of curvature join each other again consecutively and smoothly. A rotary piston 382 is movable in the chamber 352. The cross section of the rotary piston 382 is an oval of sixth order. The nappe surface of the rotary piston 382 has six convex cylindrical nappe sections 384, 386, 388, 390, 392 and 394 of relatively small radius of curvature alternating with six convex cylindrical nappe sections 396, 398, 400, 402, 404 and 406. The smaller and larger radii of curvature of the rotary piston 382 are equal to the smaller and larger radii of curvature of the chamber 352, respectively. The chamber 352 has a sevenfold symmetry, i.e. seven radial symmetry planes intersecting in a center axis 408. The rotary piston has again only a twofold symmetry: A first symmetry plane extends through the cylinder axes of the opposite convex cylindrical nappe sections 384 and 390. These two cylinder axes form again the two possible instantaneous axes of rotation 410 and 412 of the rotary piston 382. The second symmetry axis extends perpendicularly thereto through the cylinder axes of the convex cylindrical nappe sections 398 and 404.

A driving or driven shaft 414 extends longitudinally to the center axis 408. The driving or driven shaft 414 extends through an oval aperture 416 of the rotary piston 382. A pinion 418 is located on the driving or driven shaft 414. The pinion 418 meshes with one of two opposite concave toothed racks 420 and 422 curved about the axes of rotation 410 and 412, respectively. Thus, the rotary movement of the rotary piston 382 is transmitted to the driving or driven shaft or vice versa. This assembly is operating in the same way as the assembly described in detail with reference to FIG. 1.

Figure 12:
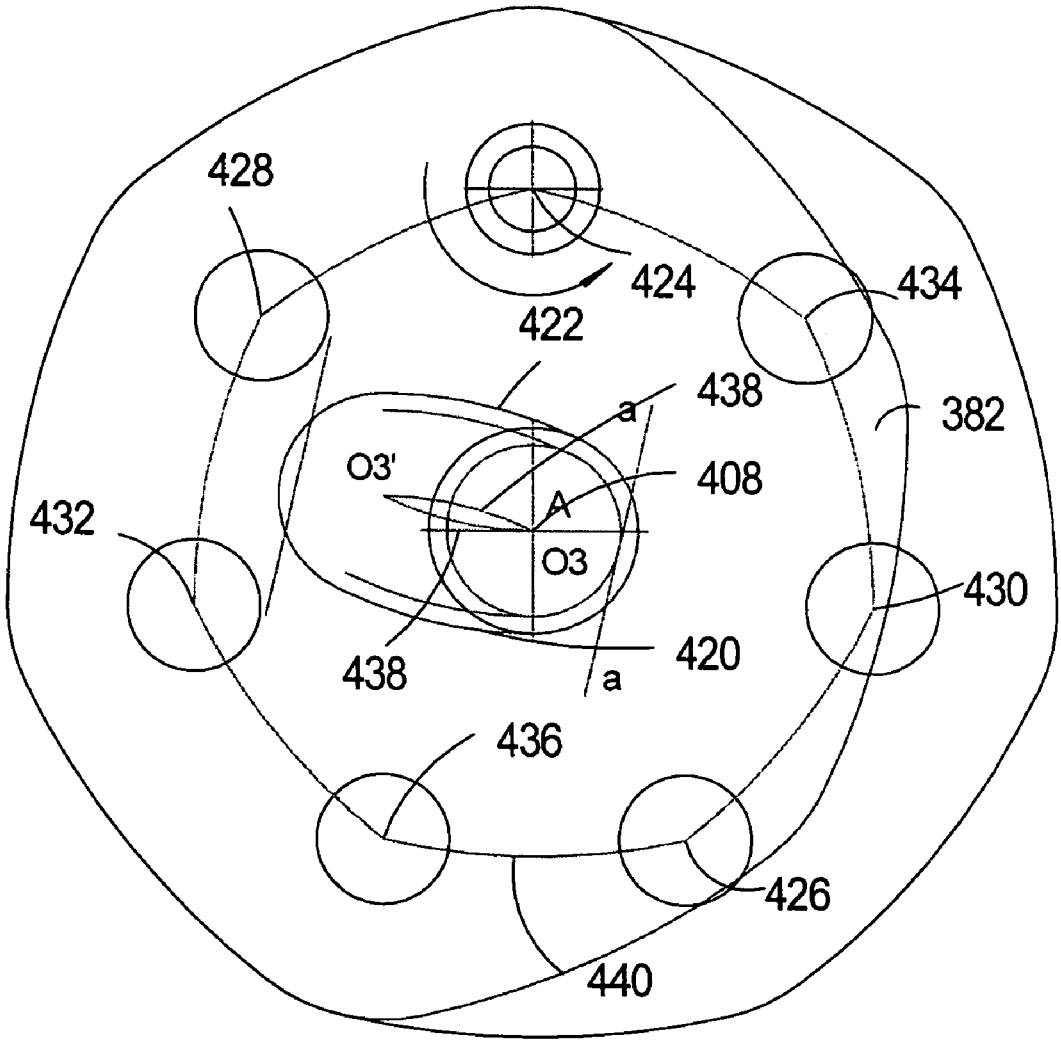
FIG. 12 shows, similarly to FIG. 4 for an arrangement according to FIG. 3, the single trajectory of the possible axes of rotation of the rotary piston relative to the housing as well as the trajectory of the axis of the driving shaft relative to the rotary piston.

FIG. 12 is similar to FIG. 4 or FIG. 8, referring however to the embodiment according to FIG. 3. It shows seven chamber-fixed axes of rotation, the rotary piston 382 rotating about these axes with its instantaneous axes of rotation 410 or 412 in the consecutive intervals of movement. These are the cylinder axes of the concave cylindrical inner wall surfaces with smaller radius of curvature. The chamber-fixed axes of rotation consecutively coming into function are designated in FIG. 12 by 424, 426, 428, 430, 432, 434 and 436. The trajectory of the center axis 408 with reference to the rotary piston 382 is designated in FIG. 12 by 438. 440 is the trajectory, which the axis of rotation 412 or 410 traverses when rotating about the respective other one of the piston-fixed instantaneous axes of rotation 410 and 412, respectively. This is an arcuate seven-angle which again is not traversed continuously.

Figure 13:
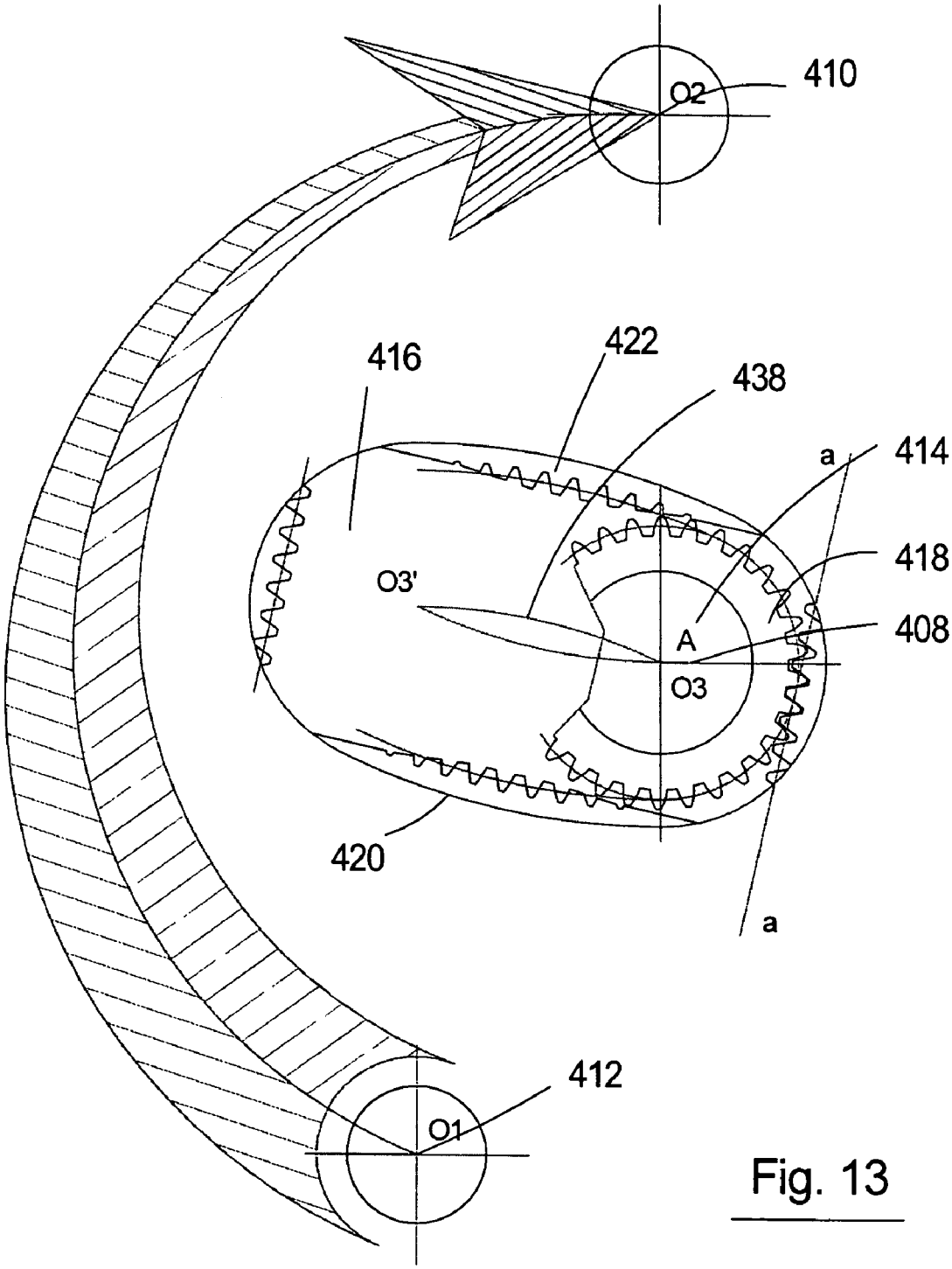
FIG. 13 shows, similarly to FIG. 4, the kinematics of the power transmission system in an arrangement of FIG. 3 with the toothed racks.
Figure 14:
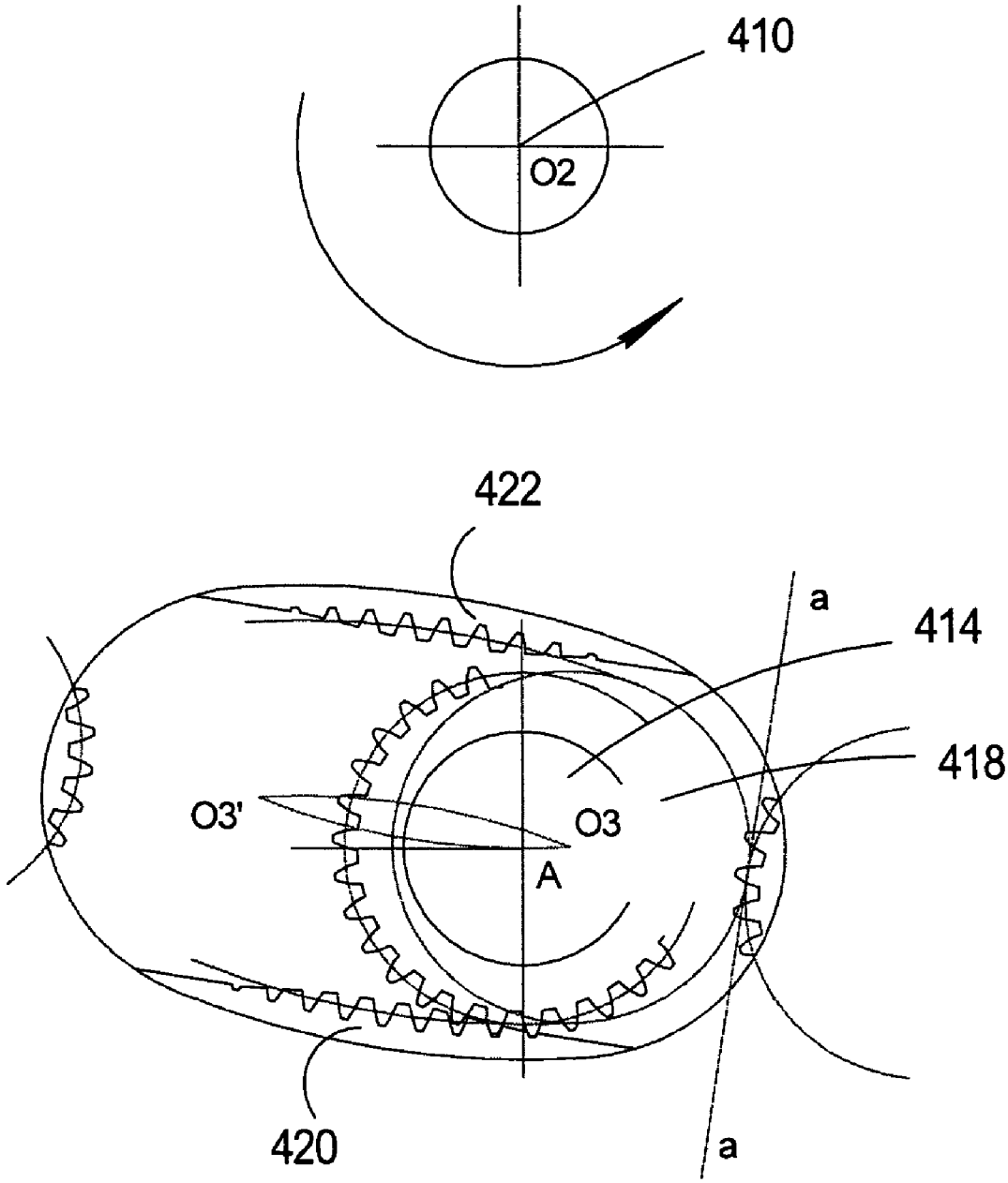
FIG. 14 shows, similarly to FIG. 5, the kinematics of the power transmission system in an arrangement of FIG. 3 a the moment shortly after leaving the stop position with convex toothed arcs.

FIGS. 13 and 14 correspond, for the embodiment according to FIG. 3, to FIGS. 5 and 6 in the embodiment of FIG. 1, and to FIGS. 9 and 10 in the embodiment of FIG. 2. The function is the same as there. However, the apertures in FIG. 2 and FIG. 3 are increasingly compact because the "strokes" of the pistons are smaller with each working cycle.

The FIGS. 15.1 to 15.28 show the movement course of the rotary piston 382 in the embodiment according to FIG. 3 for a complete revolution of the rotary piston. A solid circle marks the respective instantaneous axis of rotation. In the stop position, the kinematics does not determine exactly which axis 410 or 412 is the instantaneous axis of rotation. Therefore, two semi-solid circles mark the two axes of rotation 410 and 412. Igniting injected fuel or an introduced working medium, as, for example, illustrated in FIG. 15.2 could then urge the rotary piston diagonally to the right downwards in FIG. 15.2 instead of causing a further rotation. The rotary piston may then jam between the inner wall sections 368 and 374. For this reason, fixing means for example of the type of FIG. 16 are again provided herein for the piston fixed instantaneous axes of rotation 410 or 412 on the chamber fixed axes of rotation 424, 426, 428, 430, 432, 434 and 436.

The FIGS. 15.1 to 15.28 show that with a complete revolution of the rotary piston 382 there are all, in all, eight working strokes, with the associated intake, compression and exhaust strokes.

As in the embodiments according to FIG. 2 and FIG. 3 there are six and eight working strokes, respectively, per revolution of the driving shaft 302 and 414, respectively, such rotary piston machines may better operate with high torque than a rotary piston machine according to FIG. 1. With slowly operating rotary piston machines of the present type, the risk is particularly high that the rotary piston jams. On one hand, the rotary momentum of the rotary piston forcing a further rotation does not cure the unclear kinematics in the stop positions. On the other hand, the wedge angle between the inner wall sections between which the rotary piston may be wedged, decreases with increasing order. Thus, fixing the instantaneous axis of rotation according to FIG. 16 should be of particular importance for the rotary piston machines with ovals of higher order.

The described arrangements may be modified in multiple ways. For instance, the surfaces of the rotary piston 60 curved about the possible instantaneous axes of rotation, for example 112 and 114 in FIG. 1, need not be curved themselves exactly cylindrically about the instantaneous axes of rotation 112 and 114, respectively. The invention may also be realised in such a manner that the contact surfaces of the seals are located on a cylinder surface about the instantaneous axes of rotation. This shall also be covered by the term "cylindrical nappe sections".

What is claimed is:

1. A rotary piston machine, comprising (a) a housing defining a prismatic chamber the cross section of which forms an oval of odd order, which is alternatively composed of circular arcs having a first relatively small radius of curvature and circular arcs having a second, relatively large radius of curvature, said circular arcs changing into each other continuously and differentially, whereby corresponding first and second cylindrical inner wall sections of said chamber are formed, (b) a prismatic rotary piston on which diametrically opposite, cylindrical nappe sections having said first radius of curvature are formed, of which, in each position, a respective one is rotatable in a first one of said cylindrical inner wall sections and the respective other one engages an opposite one of said second inner wall sections, whereby said rotary piston, in each position, subdivides said chamber into two working chambers, the volumes of which, with progressive rotation of the rotary piston are alternatively increased and reduced, said cylindrical nappe sections defining a center plane, in which piston-fixed instantaneous axes of rotation of the rotary piston extending along the cylinder axes of said cylindrical nappe sections are defined, (c) means for cyclically passing working medium into the working chambers and letting it escape therefrom, said rotary piston, in each interval of movement rotating with a first one of said diametrically opposite nappe sections in a first inner wall section about a first associated instantaneous axis of rotation, which extends along the cylinder axis of said first inner wall section, and sliding with the second one of said diametrically opposite nappe sections along the opposite second inner wall section of the chamber into the next following first inner wall section of the chamber and reaching a stop position there; and the instantaneous axis of rotation subsequently jumping, for the next interval of movement, into a changed position defined by said consecutive inner wall section and corresponding to the other piston-fixed axis of rotation, and (d) means for coupling a driving or driven shaft with said the rotary piston, and further comprising (e) fixing means for temporarily fixing said instantaneous axis of rotation for the subsequent interval of movement, when said changed position has been reached.

2. A rotary piston machine as claimed in claim 1, wherein said fixing means release said rotary piston prior to reaching the next one of said stop positions.

3. A rotary piston machine as claimed in claim 2, wherein (a) said fixing means comprise complimentary coupling structures on one end face of said rotary piston in the area of said possible piston-fixed instantaneous axes of rotation, and (b) housing-side axially movable shafts having complementary coupling structures on the axes of said first cylindrical inner wall sections, said coupling structures being moved into engagement with said coupling structures of the rotary piston to fix the respective instantaneous axis of rotation.

4. A rotary piston machine as claimed in claim 3, wherein (a) the piston-side coupling structures are conical recesses in the end faces of said rotary piston and (b) said shaft-side coupling structures are conical heads, means being provided for inserting said conical heads into the conical recesses to establish the coupling.

5. A rotary piston machine as claimed in claim 4, wherein said inserting means are electrical actuators.

6. A rotary piston machine as claimed in claim 1, wherein (a) a driving or driven shaft with a pinion thereon extends centrally through said chamber, and (b) said rotary piston has an aperture therethrough which is elongated in cross section, the longer axis of said aperture being normal to a center plane of the rotary piston, and (c) said aperture has an internal toothing which meshes with said pinion.

7. A rotary piston machine as claimed in claim 5, wherein sensor means are provided for controlling said electrical actuators, said sensor means responding to rotary motion of said driving or driven shaft.

8. A rotary piston machine as claimed in claim 6, wherein (a) said internal toothing has opposite concave gear racks on both sides of the longer axis of said aperture, and (b) the internal toothing, furthermore, comprises non-concave end toothings at the ends of said aperture.

9. A rotary piston machine as claimed in claim 8, wherein said end toothings are linear gear racks.

10. A rotary piston machine as claimed in claim 8, wherein the end toothings are convex gear racks.

11. A rotary piston machine as claimed in claim 1, wherein the cross section of said rotary piston is also an oval, which alternatively is composed of circular arcs which change into each other continuously and differentially, whereby respective first and second cylindrical nappe sections are formed.

12. A rotary piston machine as claimed in claim 1, wherein (a) longitudinal grooves are formed in said diametrically opposite cylindrical nappe sections of said rotary piston, the grooves accommodating seals for sealing between said working chambers, said seals engaging the inner surface of the chamber, and (b) valve means for connecting said longitudinal grooves, with the working chamber of higher pressure, if a large pressure difference occurs, said valve means being controlled by the pressure difference between said working chambers.

13. A rotary piston machine as claimed in claim 12, wherein (a) said valve means comprise a bore provided in said rotary piston and interconnecting said working chambers adjacent said rotary piston, (b) sleeve-shaped closure pieces having longitudinal connecting bores separating said bore, at both ends, from said working chambers, (c) a slide valve is guided in said bore and is provided with reduced diameter sections on both sides, whereby, in end positions of said slide valve, a respective reduced diameter section engages said connection bore of the adjacent one of said closure pieces.

14. A rotary piston machine as claimed in claim 12, wherein said seals have a convex profile matching with the radius of curvature of one of said cylindrical inner wall sections.

15. A rotary piston machine as claimed in claim 14, wherein (a) pairs of parallel grooves and seals are provided in said two diametrically opposite cylindrical nappe sections, (b) one seal of each pair has a convex profile with the first radius of curvature, and the other seal of each pair has a convex profile with the second radius of curvature.

16. A rotary piton machine as claimed in claim 14, wherein said seals are longitudinally subdivided into notional strips, the radius of curvature in at least one strip is equal to the smaller radius of curvature of said first inner wall sections and in at least one strip is equal to the larger radius of curvature of said second inner wall sections.

17. A rotary piston machine as claimed in claim 16, wherein each of the seals, in two outer strips has the smaller radius of curvature and, in the intermediate inner strip, has the larger radius of curvature.

18. A rotary piston machine as claimed in claim 1, wherein (a) the cross section of the chamber of the rotary piston machine is an oval of odd order $(2n+1)>3$, and (b) the cross section of the rotary piston is an oval of even order 2n, in particular a quatro-oval or a sext-oval, (c) the rotary piston having two diametrically opposite main apexes with the two diametrically opposite cylindrical nappe surfaces, and the piston-side possible instantaneous axes of rotation are located on the center plane interconnecting the main apexes.

19. A rotary piston machine as claimed in claim 1, wherein the combustion chamber has a cross section which has the shape of a figure of equal height, and the piston has a shape adapted to the shape of the combustion chamber, wherein the piston is mirror-symmetric to the center plane, the center plane intersecting two centers of curvature of the combustion chamber which have maximum distance from each other, and the nappe of the piston, in one stop position on one side of the center plane, completely abuts the inner wall of the smaller portion of the combustion chamber resulting therefrom.

20. A rotary piston machine, comprising (a) a housing defining a prismatic chamber the cross section of which forms an oval of odd order, which is alternatively composed of circular arcs having a first relatively small radius of curvature and circular arcs having a second, relatively large radius of curvature, which arcs change into each other continuously and differentially, whereby corresponding first and second cylindrical inner wall sections are formed, (b) a prismatic rotary piston, on which diametrically opposite, cylindrical nappe sections having the first radius of curvature are formed, of which, in each position, a respective one is rotatable in a first cylindrical inner wall section and the respective other one engages an opposite inner wall section, whereby the rotary piston, in each position, subdivides the chamber into two working chambers, the volumes of which, with progressive rotation of the rotary piston are alternatively increased and reduced, the cylindrical nappe sections defining a center plane, in which piston-fixed instantaneous axes of rotation of the rotary piston extending along the cylinder axes of the cylindrical nappe sections are defined, (c) means for cyclically passing working medium into the working chambers and letting it escape therefrom, the rotary piston, in each interval of movement rotating with a first one of the diametrically opposite nappe sections in a first inner wall section about a first associated instantaneous axis of rotation, which extends along the cylinder axis of the first inner wall section, and sliding with the second one of the diametrically opposite nappe sections along the opposite second inner wall section of the chamber into the consecutive first inner wall section of the chamber and reaching a stop position there; and the instantaneous axis of rotation subsequently jumping, for the next interval of movement, into a changed position defined by said consecutive inner wall section and corresponding to the other piston-fixed axis of rotation, and (d) means for coupling a shaft with the rotary piston, wherein (e) the cross section of the chamber of the rotary piston machine is an oval of the odd order $(2n+1)>3$, and (f) the cross section of the rotary piston is an oval of the even order 2n, in particular a quatro-oval or a sext-oval, (g) the rotary piston having two diametrically opposite main apexes with the two diametrically opposite cylindrical nappe surfaces, and the piston-side possible instantaneous axes of rotation are located on the center plane interconnecting the main apexes.

* * * * *